US005632129A

United States Patent [19]

Imai et al.

[11] Patent Number: 5,632,129

[45] Date of Patent: May 27, 1997

[54] JOINT DEVICE FOR JOINING PRETENSIONED BRACE MEMBER TO CONNECTOR NODES IN SPACE TRUSS STRUCTURE

[75] Inventors: Katsuhiko Imai; Yasuhiro Yamaoka; Nobuyuki Yasui, all of Hyogo; Masayoshi Kurashige, Kanagawa, all of Japan

[73] Assignee: Kawatetsu Kenzai Kabushiki Kaisha, Hyogo, Japan

[21] Appl. No.: 601,007

[22] PCT Filed: Jul. 5, 1995

[86] PCT No.: PCT/JP95/01343

§ 371 Date: Feb. 23, 1996

§ 102(e) Date: Feb. 23, 1996

[87] PCT Pub. No.: WO96/02710

PCT Pub. Date: Feb. 1, 1996

[30] Foreign Application Priority Data

Jul. 14, 1994 [JP] Japan ..... 6-186577

[51] Int. Cl.[6] ..... E04B 1/19; F16B 7/18

[52] U.S. Cl. ..... 52/655.1; 52/81.1; 52/655.2; 403/169; 403/171

[58] Field of Search ..... 52/655.1, 655.2, 52/653.2, 81.1; 403/176, 171, 169, 217

[56] References Cited

U.S. PATENT DOCUMENTS

| | | | |
|---|---|---|---|
| 3,494,708 | 2/1970 | Nunlist et al. | 403/217 X |
| 3,789,562 | 2/1974 | De Chicchis et al. . | |
| 3,864,049 | 2/1975 | Ono | 403/171 |
| 4,438,615 | 3/1984 | Wendel | 52/655.2 |
| 4,646,504 | 3/1987 | Britvec | 52/655.2 |
| 4,677,804 | 7/1987 | Holt . | |
| 4,872,779 | 10/1989 | Imai . | |
| 5,051,019 | 9/1991 | Kohl | 403/171 |
| 5,054,950 | 10/1991 | Zillgen et al. | 403/171 |
| 5,141,351 | 8/1992 | Imai | 403/176 X |
| 5,399,043 | 3/1995 | Plumeyer | 403/176 X |
| 5,498,093 | 3/1996 | Imai | 403/171 |
| 5,498,094 | 3/1996 | Imai | 403/171 |

FOREIGN PATENT DOCUMENTS

| | | | |
|---|---|---|---|
| 477946 | 10/1951 | Canada | 403/176 |

*Primary Examiner*—Carl D. Friedman
*Assistant Examiner*—Laura A. Saladino
*Attorney, Agent, or Firm*—Jordan and Hamburg

[57] ABSTRACT

A joint device enables to join a brace member, into which regulated pretension is exactly introduced, to unmovable connector nodes, comprising a steel rod 1 having a swelled portion 1A and a threaded connector portion 1B formed on the end thereof, respectively, one sleeve 3 providing an external threaded part 3A joined to one node 2M, which contacts a swelled portion 1A: and another sleeve 4 providing an external threaded part 4A joined to node 2N, which engages threaded connector portion 1B. The length from a node-contact face 3*c* of sleeve 3 to a node-contact face 4*c* of sleeve 4 is selected equal to difference of length between both nodes 2, 2 from length for generating a preferable elongation enough to introduce regulated pretension into steel rod 1. A brace member 13 is disposable between both nodes 2, 2 and regulated pretension is introducible thereinto when depth of connecting screw hole 2*m* of sleeve 2M is equal to or more than difference of summation of length of joining threaded part 3A, length of-swelled portion 1A and length of joining threaded part 4A from length for generating an elongation.

4 Claims, 16 Drawing Sheets

JOINT DEVICE FOR JOINING PRETENSIONED BRACE MEMBER TO CONNECTOR NODES IN SPACE TRUSS STRUCTURE

TECHNICAL FIELD OF THE INVENTION

This invention relates to a joint device for joining a pretensioned brace member to connector nodes in space truss structure and, more particularly, to a device for introducing designed pretension into a brace member diagonally disposed between connector nodes fixed to the corners of a grid formed in the space truss structure assembled by using structural members.

BACKGROUND ART

In constructing a space truss structure by joining structural members, like steel pipes, to connector nodes, the combination of grids basically having a triangle formed by structural members generally makes a truss structure. As shown in FIG. 17, which indicates a partial plan view of the framework of a dome, some grids 12 in a single layer space frame structure assembled by using structural members 11, 11 are often rectangular or pentagonoid.

The grid 12 having a figure except a triangle must be reinforced by disposing brace members on the diagonal line thereof. The dimensions and the material of a non-pretensioned brace member are chosen appropriately to not only axial compressive force but tensile force acting thereon, similarly to the choice of those of structural pipes.

On the other hand, a small-diameter pretensioned steel rod is available to a brace member in consideration of axial tensile force only acted thereon since the pretension introduced into a brace member contributes to establish a stable grid. It is hereat natural to determine the value of pretension so as not to make the grid deform against the designed load. The pretension of brace member 13 is usually provided by a turnbuckle 14 roughly drawn by a broken line at an intermediate portion of a steel rod.

The brace member 13 is easily disposed between two nodes 2, 2, which are movable and/or unmovable in the truss space, by adjusting the length thereof by means of a turnbuckle.

The turnbuckles installed on the brace members often spoil the appearance of a truss structure, especially, in the case applying them to a framework supporting glazed roof.

It is remarkably difficult to introduce designed pretension into a brace member by a turnbuckle, because an operator can hardly grap exact elongations of one half and another half of the brace member, which are separated by a turnbuckle, during construction work.

U.S. Pat. No. 4,872,779 discloses a joint device for joining a structural member to a connector node. The disclosure teaches to engage a fastening bolt, which is mounted on the edge cover closing the end opening of a steel pipe, to a connecting screw hole in the connector node by rotation of a sleeve covering the fastening bolt.

The joint device described above is not available to the connection of a small-diameter steel rod as a brace member with a connector node since a fastening bolt must be previously inserted in the edge cover of a steel pipe. Furthermore, it is impossible to introduce pretension into a steel pipe by means of such a kind of joint device.

DISCLOSURE OF THE INVENTION

An object of this invention is to propose a joint device for previously introducing pretension into a brace member so as to get smart appearances of a truss structure without turnbuckles. Another object is to provide a device for enabling to previously introduce the exact pretensile force into a brace member disposed between unmovable connector nodes.

The present invention relates to a joint device for joining a pretensioned brace member to connector nodes on the diagonal line of a grid formed in the space truss structure assembled by using structural members, the device, comprising: a brace member having a steel rod providing a swelled portion formed at one end thereof and a threaded connector portion formed on the outer surface of another end thereof, a first joint member for connecting one end of the steel rod to one connector node, and a second joint member for connecting another end of the steel rod to another connector node. The first joint member is a first sleeve providing a longitudinal hole for inserting the steel rod, the end face of which contacts a back surface of the swelled portion so as not to fall off from the steel rod. The second joint member is a second sleeve providing a longitudinal threaded hole for inserting another end of the steel rod, which covers and engages the threaded connector portion. The first sleeve comprises a first joining threaded part formed on the outer surface of node side thereof, the minor diameter of which is larger than the diameter of the swelled portion, a first polygonal swelled part having torquing surfaces formed on the outer surface thereof to rotate the first sleeve for engagement of the first joining threaded part to a connecting screw hole of the connector node, a first node-contact face formed at the boundary between the first polygonal swelled part and the first joining threaded part, which contacts a flat face of the node, and a swelled portion-contact face formed at the end of node side of the first joining threaded part, which contacts a back surface of counter-node side of the swelled portion. The second sleeve comprises a second joining threaded part formed on the outer surface of node side thereof, a second polygonal swelled part having torquing surfaces formed on the outer surface thereof to rotate the second sleeve for engagement of the second joining threaded part to a connecting screw hole of another connector node, a second node-contact face formed at the boundary between the second polygonal swelled part and the second joining threaded part, which contacts a flat face of the node, an adjusting screw hole formed inside the second joining threaded part, which communicates with the longitudinal threaded hole, an adjusting screw bolt engaging the adjusting screw hole, which regulates the length of engagement of the threaded connector portion with the longitudinal threaded hole in response of contact with another end face of the steel rod. The depth of connecting screw hole of the connector node is defined to be equal to and/or more than the difference of the summation of the length of the first joining threaded part, the length of the swelled portion and the length of the second joining threaded part from the length for generating a preferable elongation enough to introduce regulated pretension into the steel rod. And, the spiral direction of the threaded connector portion is selected opposite that of the second joining threaded part.

In accordance with the present invention, the first sleeve and the second sleeve described above enable to join a steel rod as a brace member to two unmovable connector nodes disposed on the diagonal line of each grid in the space truss structure, and to exactly introduce regulated pretension, which never makes the grid deform against the designed load, into a brace member.

Consequently a brace member comes to strong enough to resist not only compression but tension acting on connector nodes diagonally disposed in each grid. Thus, the combination of stable grids gives a truss structure with non-directional properties.

The appearance of grids is simple and smart since the intermediate portion of a brace member is a steel rod without turnbuckles. Especially, in the case that a space truss structure supports a glazed roof, the brace member providing without turnbuckles gives a geometrically proportional structure which impresses one a designing sense of high quality.

The present invention provides a brace member for introducing regulated pretension thereinto by using two sleeves and an adjusting screw bolt installed at the end of a steel rod. Accordingly, a truss structure is simple and inexpensive.

DETAILED DESCRIPTION OF THE INVENTION

Figure 1:
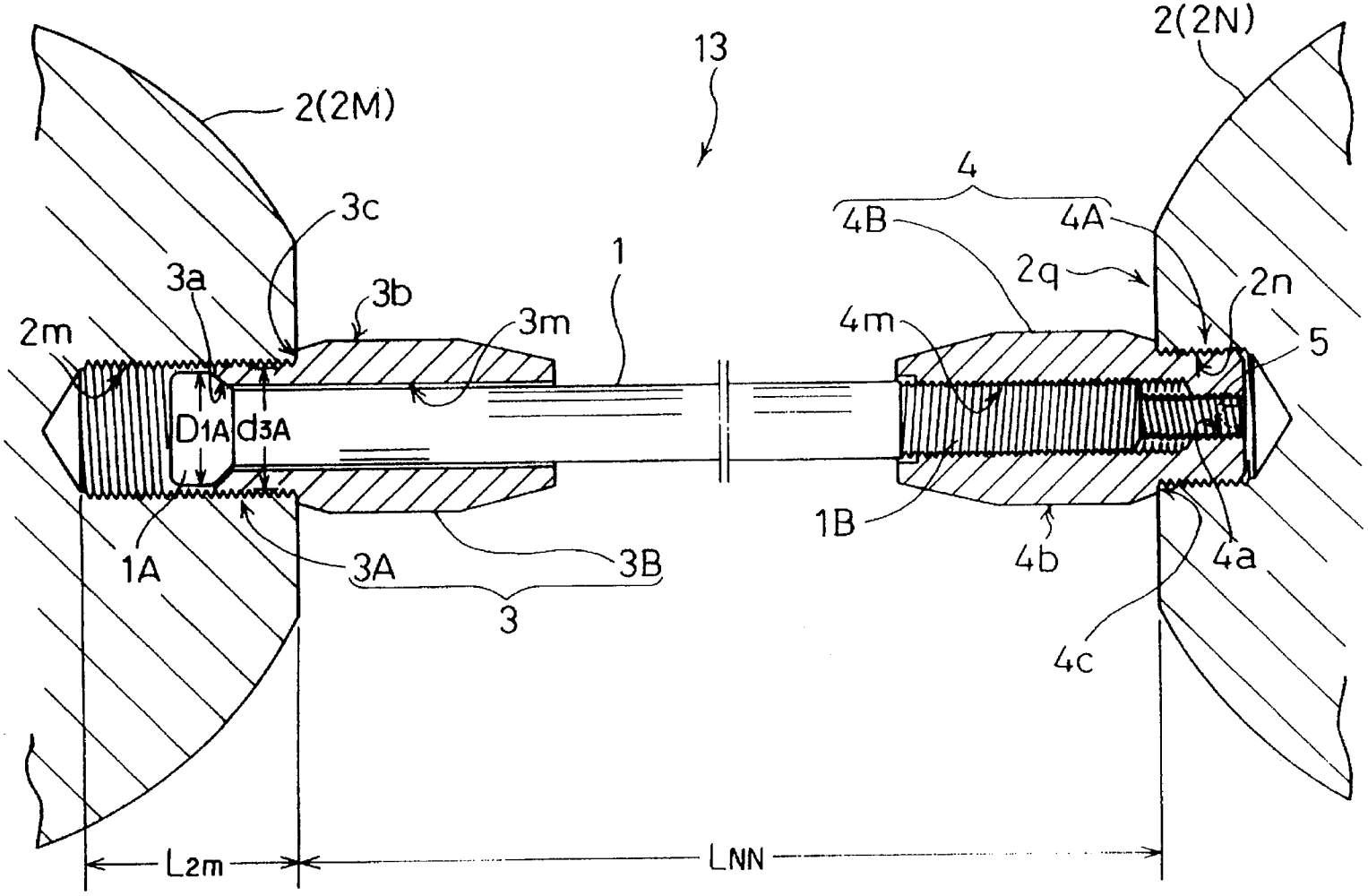
FIG. 1 is a sectional view of a first embodiment providing a brace member disposed between nodes by a device according to the present invention.

Referring to FIG. 1, showing a longitudinally sectional view of a pretensioned brace member 13, a steel rod 1 as a main part of a brace member is diagonally disposed between two connector nodes 2, 2 fixed to the corners of a grid which is formed in the space truss structure assembled by using structural members such as steel pipes.

The steel rod 1 provides a swelled portion 1A formed by forging at one end thereof and a left-handed threaded connector portion 1B formed on the outer surface of another end thereof. A joint device for joining the steel rod 1 to the connector nodes 2, 2 is as follows:

One end portion of steel rod 1, i.e., the side of swelled portion 1A, is joined to one connector node 2 by a first joint member 3, and another end portion thereof, i.e., the side of threaded connector portion 1B, is joined to another connector node 2 by a second joint member 4, respectively. The first joint member 3 is a first sleeve providing a longitudinal hole **3*m* formed therein for inserting the steel rod 1, the end face of which contacts a back surface of swelled portion 1A so as not to fall off from the steel rod. The second joint member 4 is a second sleeve providing a longitudinal threaded hole 4*m* formed therein for inserting another end of steel rod 1, which covers and engages the threaded connector portion 1B**.

The first sleeve 3 comprises a first joining threaded part 3A formed on the outer surface of node side thereof, the minor diameter $d_{3A}$ of which is larger than the diameter $D_{1A}$ of swelled portion 1A, and a first polygonal swelled part 3B having six torquing surfaces **3*b* formed on the outer surface of counter-node side thereof to rotate itself for engagement of the first joining threaded part 3A to a connecting screw hole 2*m* of the connector node 2M. A first node-contact face 3*c* is formed at the boundary between the first polygonal swelled part 3B and the first joining threaded part 3A, which contacts a flat face of the node 2M. And a swelled portion-contact face 3*a* is formed at the end of node side of the first joining threaded part 3A, which contacts a back surface of counter-node side of the swelled portion 1A**.

Figure 3:
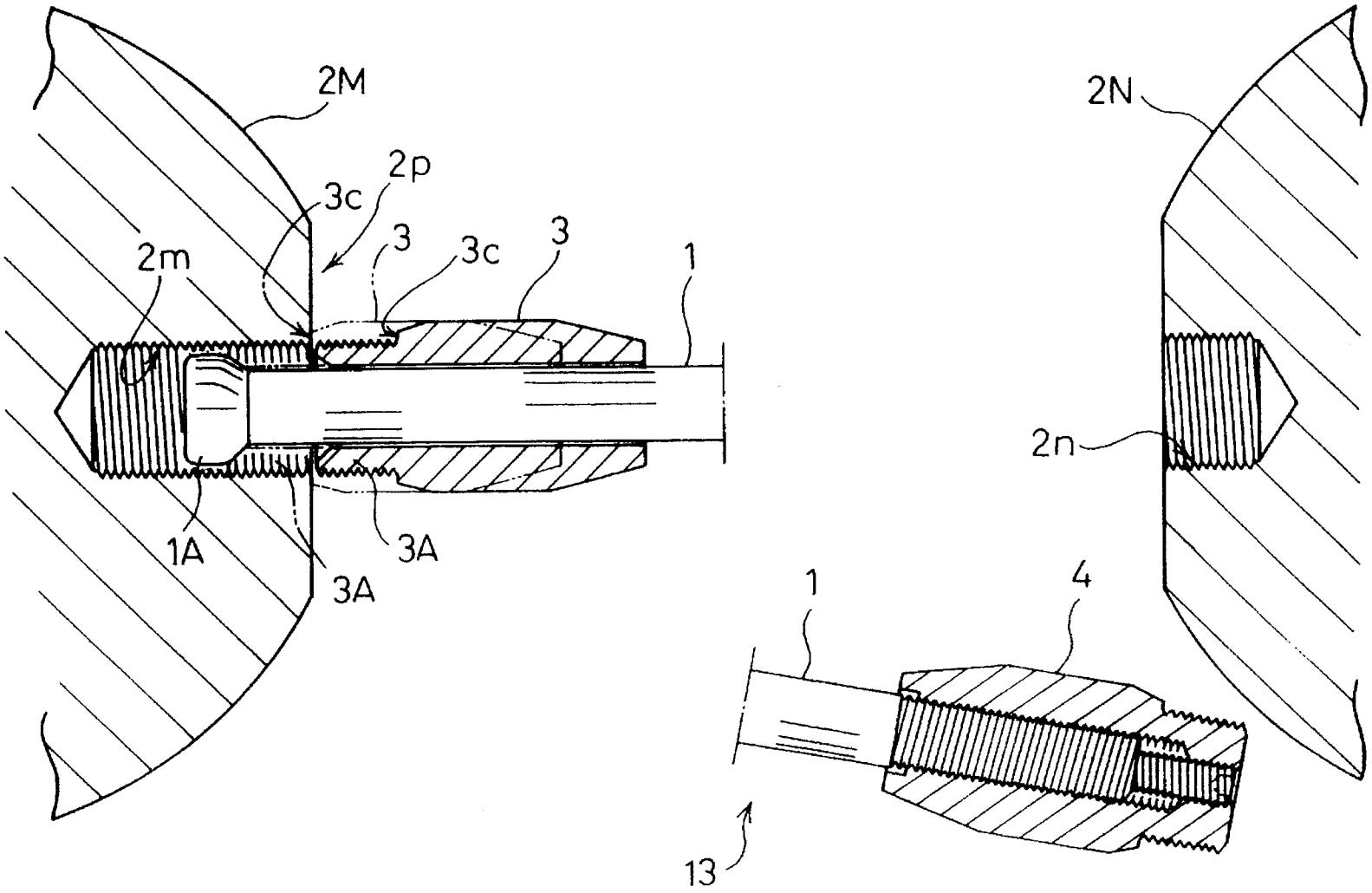
FIG. 3 is a sectional view of a brace member initially operated for joining after hoisting a brace member to connector nodes.

The reason why the minor diameter $d_{3A}$ of the first joining threaded part 3A is larger than the diameter $D_{1A}$ of the swelled portion 1A is to make the diameter of swelled portion 1A smaller than the minor diameter of connecting screw hole **2*m*. Thus, the swelled portion 1A smoothly moves in the connecting screw hole 2*m* of connector node 2M in operation from FIG. 3 to FIG. 4**, which remains to be described.

The second sleeve 4 comprises a second joining threaded part 4A formed on the outer surface of node side thereof and a second polygonal swelled part 4B having torquing surfaces **4*b* formed on the outer surface of counter-node side thereof to rotate itself for engagement of the second joining threaded part 4A to a connecting screw hole 2*n* of another connector node 2N**.

A second node-contact face **4*c* is formed at the boundary between the second polygonal swelled part 4B and the second joining threaded part 4A, which contacts a flat face of the node 2N. And an adjusting screw hole 4*a* is formed inside the second joining threaded part 4A, which communicates with the longitudinal threaded hole 4*m* and engages an adjusting screw bolt contacting another end face of the steel rod 1**.

Figure 2:
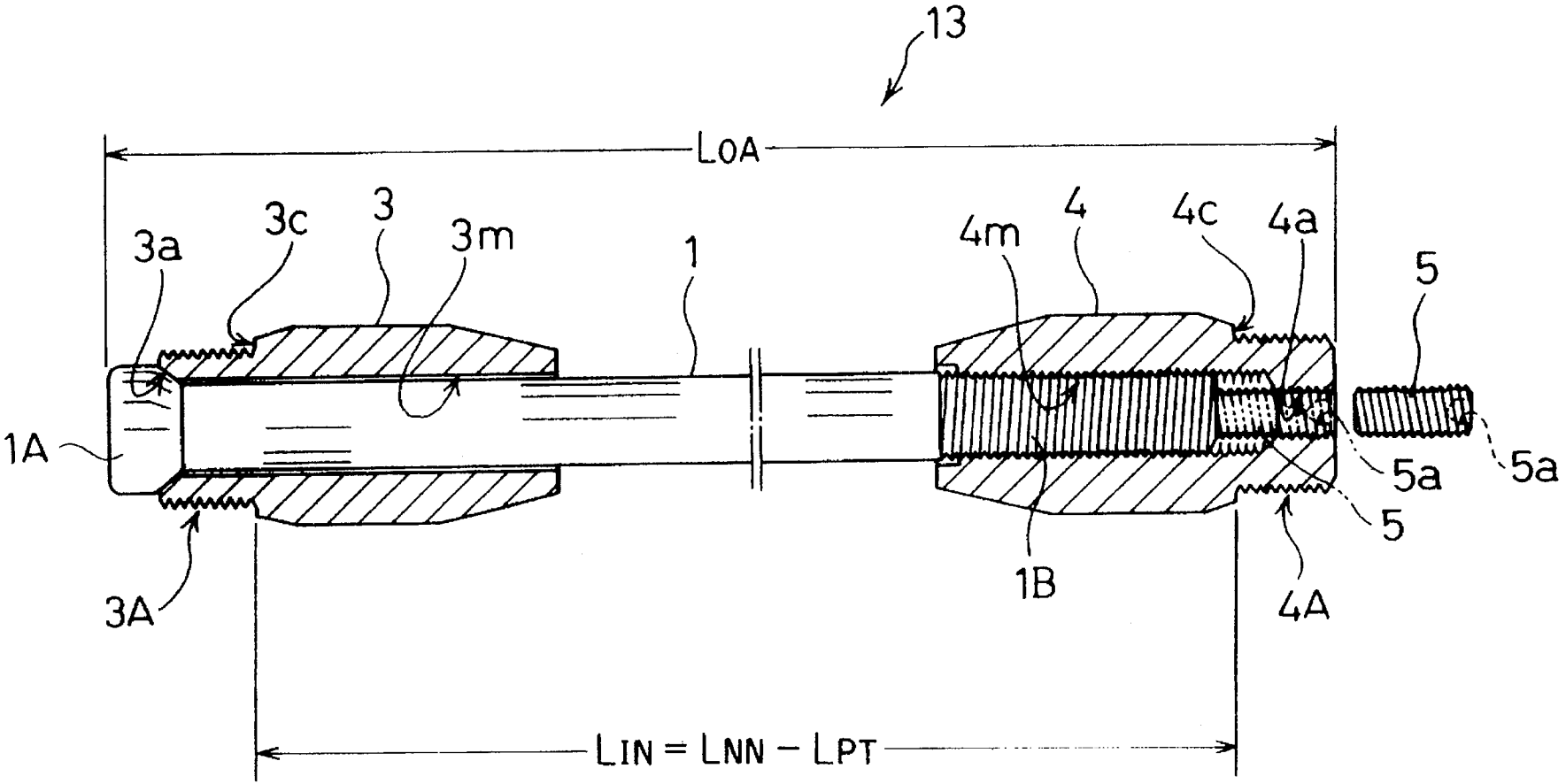
FIG. 2 is a sectional view of a brace member having an overall length regulated by adjusting the length of engagement.

The length of engagement of adjusting screw bolt 5 defines the length of engagement of the threaded connector portion 1B with the longitudinal threaded hole 4*m*. The latter length of engagement exactly gives length $L_{PT}$, see FIG. 5, for generating a preferable elongation enough to introduce regulated pretension, which is selected not to make a grid deform against designed load, into a steel rod 1 under the overall length $L_{0A}$ from the end face of swelled portion 1A to the end face of second joining threaded part 4A, shown in FIG. 2, is maintained.

Figure 5:
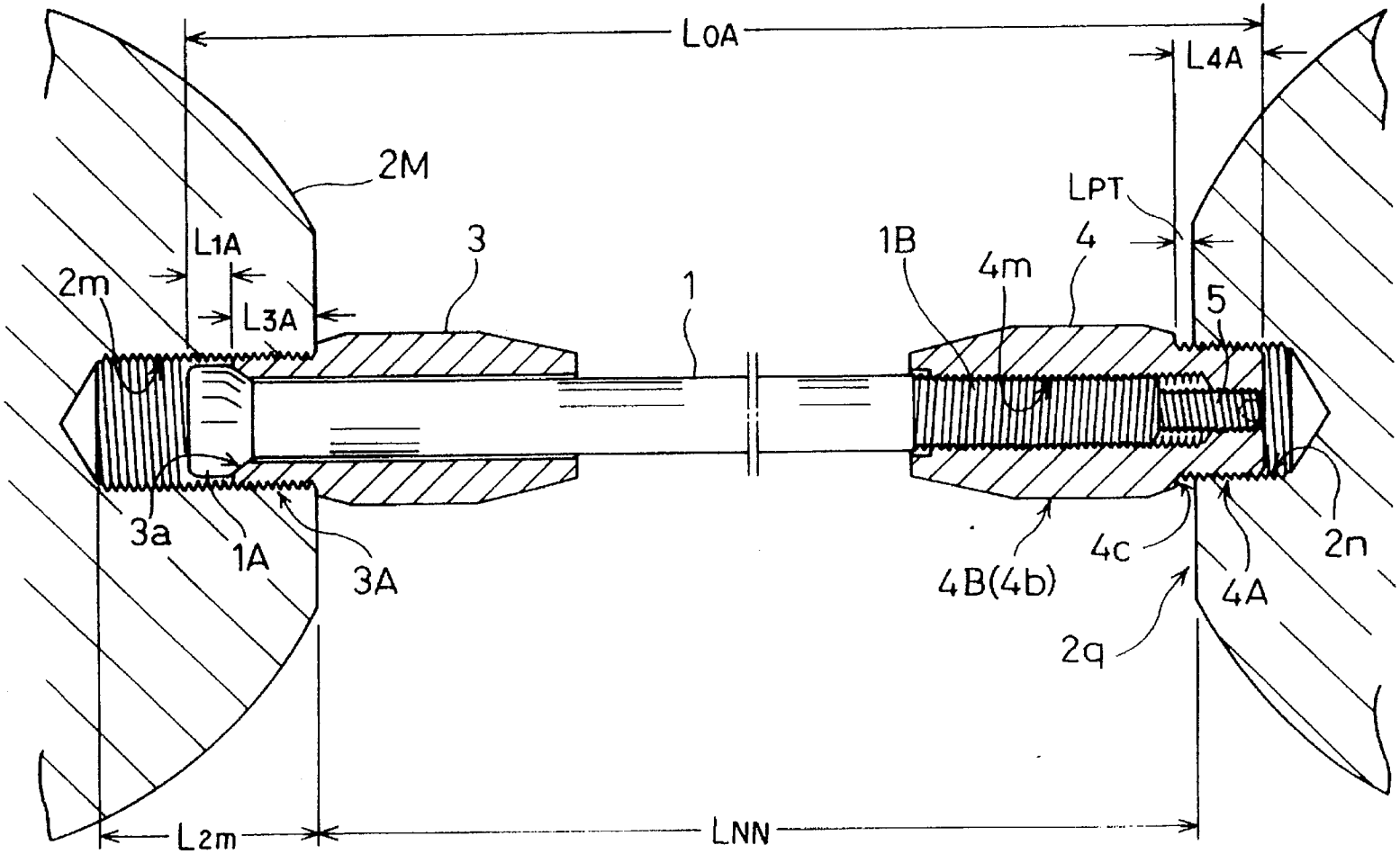
FIG. 5 is a sectional view of a brace member just prior to the completion of joining to connector nodes.

Referring again to FIG. 1, the connecting screw hole 2*n* engaging second sleeve 4 should be deep enough to engage the second joining threaded part 4A. On the other hand, the depth of the connecting screw hole 2*m* of connector node 2M engaging first sleeve 3 is defined as follows:

The depth $L_{2m}$ of the connecting screw hole, as shown in FIG. 5, is selected equal to and/or more than the difference of summation of length $L_{3A}$ of the first joining threaded part 3A, length $L_{1A}$ of the swelled portion 1A and length $L_{4A}$ of the second joining threaded part 4A from length $L_{PT}$ for generating the elongation described above.

Each tapering end parts of counter-node side of the first and second sleeves 3, 4 in Figure contributes to lighten the sleeve.

In consideration of joining work of brace members most of threaded parts and screws are generally right-handed ones. Especially, the first joining threaded part 3A and the connecting screw hole 2*m* for joining the first sleeve B to connector node 2M are right-handed to facilitate torquing by using a wrench, similarly to the second joining threaded part 4A and the connecting screw hole 2*n*.

On the other hand, the direction of spiral of the threaded connector portion 1B is selected opposite that of the second joining threaded part 4A etc. Consequently, the selection of such spiral directions prevents the engagement of the threaded connector portion 1B with the longitudinal threaded hole 4*m* from releasing in response to engaging second joining threaded part 4A to connecting screw hole 2*n*. Accordingly, the length $L_{0A}$ from the end face of swelled portion 1A to the end face of second joining threaded part 4A is maintained under no axial force acting on the steel rod 1.

Since the adjusting screw bolt 5 prevents the length of engagement of threaded connector portion 1B with the longitudinal threaded hole 4*m* from increasing in response to the right-hand rotation of second sleeve 4, the length $L_{0A}$ described above never shortens.

The procedure for joining a steel rod 1 having a regulated length to unmovable connector nodes 2, 2 and for introducing regulated pretension into the steel rod 1 is as follows:

Referring to FIG. 2, the threaded connector portion 1B of steel rod 1 is inserted into the longitudinal hole 3*m* of first sleeve 3 from the side of first joining threaded part 3A until the swelled portion-contact face 3*a* contacts the surface counter-node side of the swelled portion 1A.

The threaded connector portion 1B is covered with the second sleeve 4, and is engaged to the longitudinal threaded hole 4*m* by the left-hand rotation of the second sleeve so that the length from the first node-contact face 3*c* of the first sleeve 3 to the second node-contact face 4*c* of the second sleeve 4 is equal to the difference $L_{IN}$ of the designed length $L_{NN}$, see FIG. 1, between two unmovable connector nodes 2, 2 from length $L_{PT}$, see FIG. 5, for generating a preferable elongation enough to introduce regulated pretension into the steel rod.

The adjusting screw bolt 5 is engaged to the adjusting screw hole 4*a* formed inside the second joining threaded part 4A by the rotation of an undrawn hexagonal wrench inserted into a hole 5*a* until the adjusting screw bolt 5 contacts the threaded connector portion 1B as shown by double dotted chain lines.

The procedure described above establishes an overall length $L_{0A}$ from the end face of swelled portion 1A of steel rod 1 to the end face of second joining threaded part 4A of second sleeve 4. Not only a right-handed screw but a left-handed screw are available to the adjusting screw bolt 5 if an adhesive material for screw locking is used to fix the adjusting screw bolt to the adjusting screw hole.

The procedure described above is performed by manufactory work. Even if the length of engagement of the threaded connector portion 1B with the longitudinal threaded hole 4*m* decreases during the transportation of brace members, the left-hand rotation of second sleeve 4 until the adjusting screw bolt contacts again the end face of the threaded connector portion at the constructing site easily presents the same overall length $L_{0A}$ again. A brace member 13 are hoisted to a grid in the truss structure and the first sleeve 3 is faced the connecting screw hole 2*m* of one connector node 2M as shown by solid lines in FIG. 3. The second sleeve 4 is in proximity of another connector node 2N since a long steel rod 1 is deflectable.

The swelled portion 1A is inserted into the connecting screw hole 2*m* by pushing the steel rod 1 in the direction of the connector node 2M as shown by solid lines. The right-hand rotation of first sleeve 3 engages the first joining threaded part 3A to the connecting screw hole 2*m* as shown by double dotted chain lines. The first node-contact face 3*c* contacts closely to the flat face 2*p* of the connector node 2M by torquing the sleeve.

Figure 4:
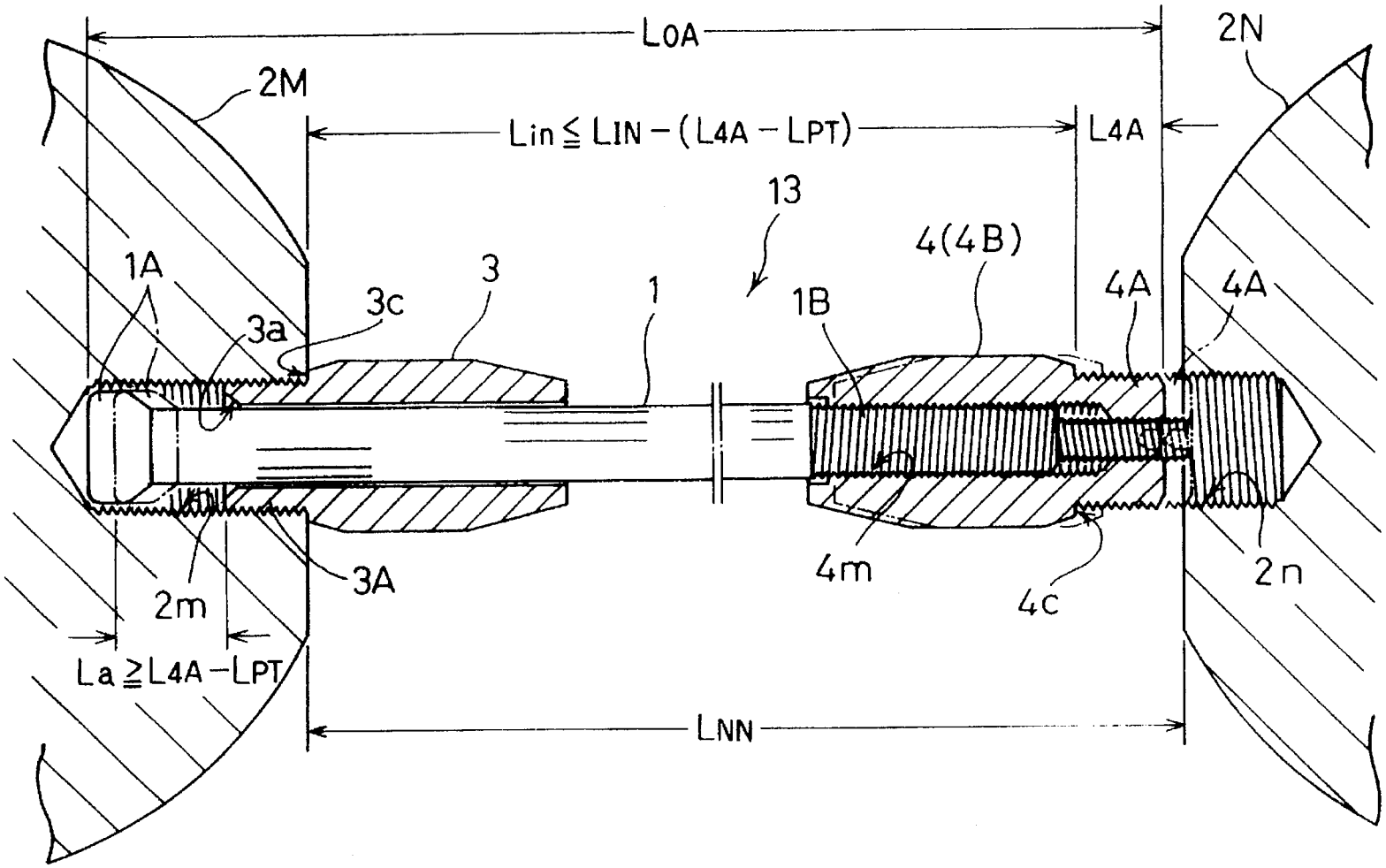
FIG. 4 is a sectional view of a brace member disposed between connector nodes.

Referring to the solid lines in FIG. 4, the steel rod 1 is further deeply pushed into the connecting screw hole 2*m* so that the length L between the swelled portion 1A inside the connecting screw hole 2*m* of connector node 2M and the swelled portion-contact face 3*a* of first joining threaded part 3A is equal to and/or more than the difference of length $L_{4A}$ of the second joining threaded part 4A from length $L_{PT}$ for generating a preferable elongation enough to introduce regulated pretension into the steel rod. Accordingly, the second sleeve 4 moves in the direction of the first sleeve 3 in response to the movement of steel rod 1.

Consequently, the length Lin from the first node-contact face 3*c* of first sleeve 3 to the second node-contact face 4*c* of second sleeve 4 comes to be less than $L_{IN}-(L_{4A}-L_{PT})$. Since $L_{1N}$ is the difference of length $L_{NN}$ between unmovable nodes 2M, 2N from length $L_{PT}$ for generating a preferable elongation enough to introduce regulated pretension into the steel rod, see FIG. 2, a following equation is given.

$$L_{in} \leq L_{IN}-(L_{4A}-L_{PT})=(L_{NN}-L_{PT})-(L_{4A}-L_{PT})=L_{NN}-L_{4A}$$

The length $L_{in}+L_{4A}$ from the first node-contact face 3*c* of first sleeve 3 to the end face of second joining threaded part 4A of second sleeve 4 is given as follows:

$$L_{in}+L_{4A} \leq L_{NN}-L_{4A}+L_{4A}=L_{NN}$$

This means that the second sleeve 4 is to face the connecting screw hole 2*n* of connector node 2N.

A little pulling the steel rod 1 in the right-hand direction as shown by double dotted chain lines, see FIG. 4, makes the second joining threaded part 4A contact the opening of connecting screw hole 2*n* of connector node 2N. The light right-hand rotation of the second sleeve 4 achieves an engagement of the second joining threaded part 4A to the connecting screw hole 2*n*. The rotation of second sleeve 4 becomes heavily as soon as the end face of counter-node side of the swelled portion 1A contacts the swelled portion-contact face 3*a* of first joining threaded part 3A as shown in FIG. 5.

According to above procedure, the length from the end face of swelled portion 1A to the end face of second joining threaded part 4A is reappeared to $L_{OA}$ presented in FIG. 2. In addition, the length $L_{PT}$ for generating an elongation remains between the second node-contact face 4*c* of second sleeve 4 and the flat face 2*q* of connector node 2N. Torquing second sleeve 4 by a wrench engaging second polygonal swelled part 4B thereof elastically elongates the steel rod 1 since the nodes 2M, 2N are not moved by the grids already constructed close thereto.

As shown in FIG. 1, the entire engagement of the second joining threaded part 4A to the connecting screw hole 2*n* until the second node-contact face 4*c* contacts the flat face 2*q* gives the steel rod 1 a preferable elongation introducing regulated pretension thereinto.

When the length $L_{NN}$ between both nodes is 3,000 mm, the length $L_{PT}$ for generating an elongation introducing regulated pretension is 5 mm and Young's modulus is $2.1\times10^4$ kgf/mm$^2$, the tensile stress of steel rod 1 comes to $2.1\times10^4\times5/3{,}000=35$ kgf/mm$^2$. The pretension determined at design work is introduced into the steel rod 1 with high accuracy so as not to make a grid deform against the designed load since the construction error of the length between nodes of grid to which the present invention is applied is achieved within ±1 mm only.

Figure 17:
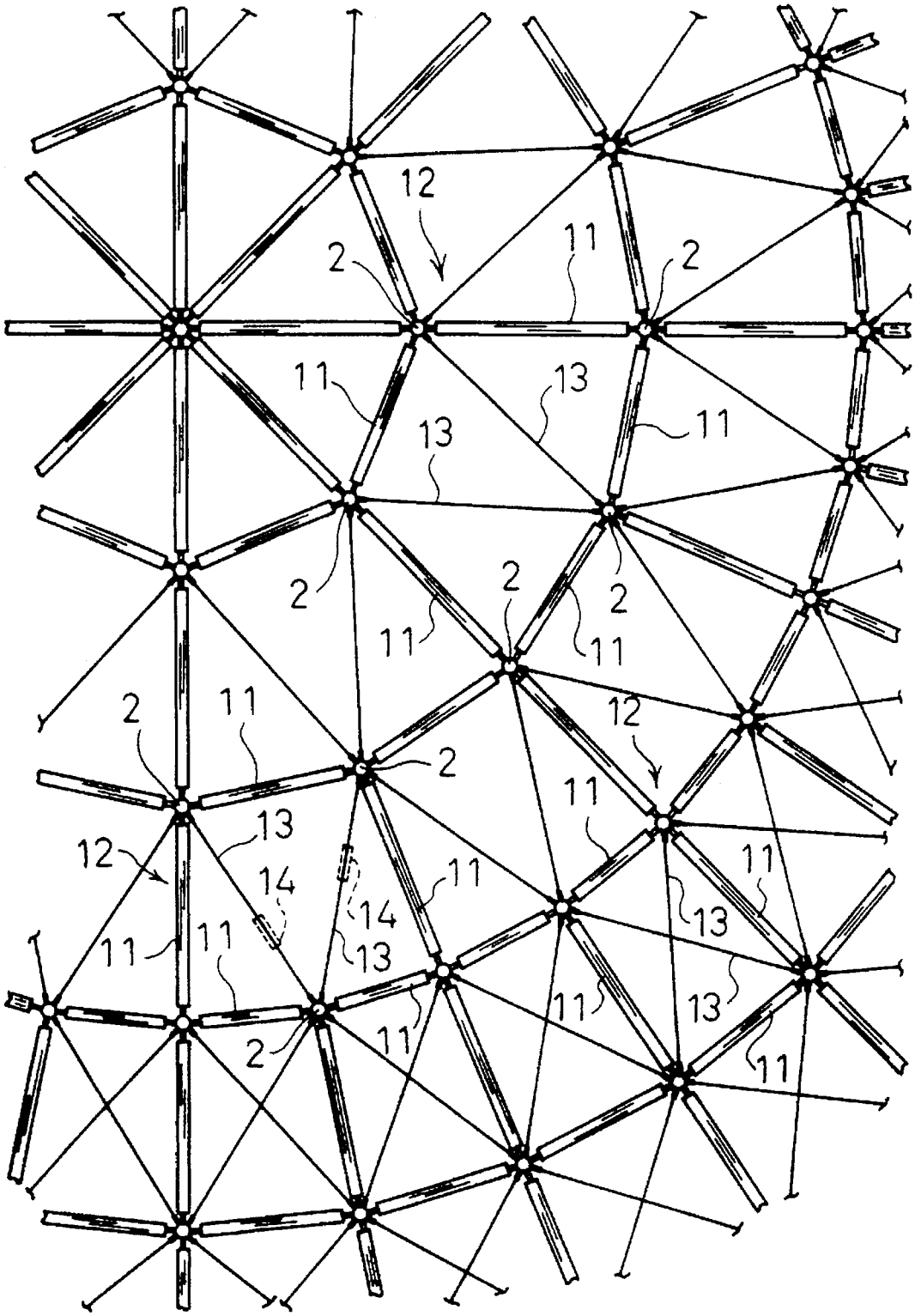
FIG. 17 is a plan view of a quarter of a domed roof constructed by the combination of grids having brace members among structural members.

According to the above description, steel rods with only 13 mm-diameter are available if they are high tension steel of the order of 100 kgf/mm$^2$ in the case that the steel pipes of 139.8 mm-diameter are used as structural members forming grids 12 in FIG. 17.

In accordance with the above structure, the brace member length of which is regulated to Lo, shown in FIG. 2, is joinable to both nodes by moving one end of steel rod 1 inside the connecting screw hole 2*m* of connector node 2M even if the length between nodes have already established. The reversal procedure naturally enables to remove a brace member from a grid.

The pretensioned brace member presents a stable grid with much higher rigidity according to high compressive resistance given along the diagonal line through the nodes. The appearance of a truss structure comes to simple and smart because of no turnbuckles. The brace member having the joint device in accordance with the present invention impresses one a proportional designing sense of high quality, especially in a space truss structure supporting a glazed roof.

The operations from FIG. 4 to FIG. 5 and from FIG. 5 to FIG. 1, which are subject to the right-hand rotation of second sleeve 4, never changes the length of engagement of the threaded connector portion 1B with the left-handed longitudinal threaded hole 4*m*.

Figure 6:
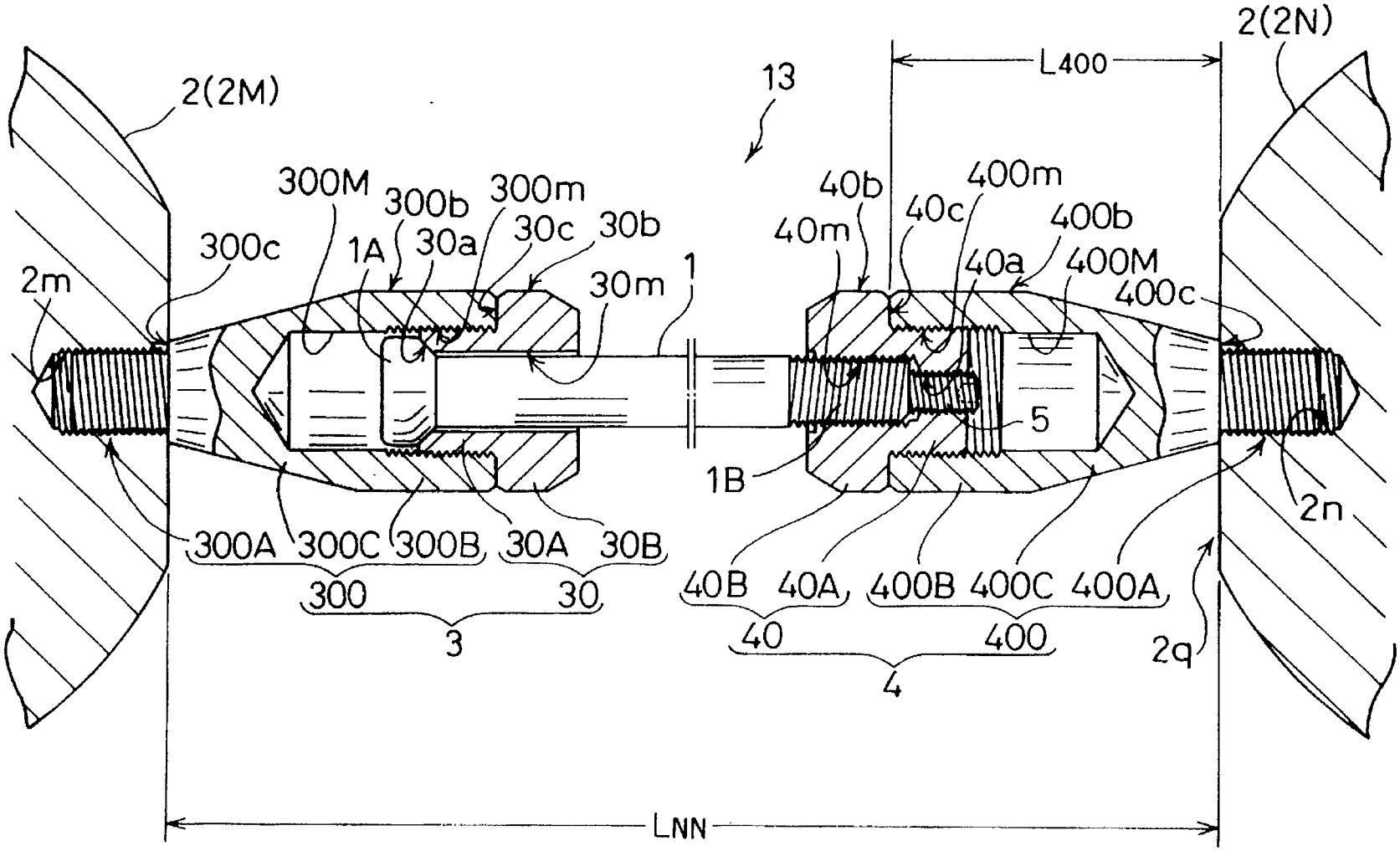
FIG. 6 is a sectional view of a second embodiment providing a brace member joined to nodes by a device according to the present invention.

FIG. 6 shows another joint device comprising sleeves and connecting adapters. The latter is a tapered one to preferably join to a residual narrow flat face of a connector node joining a lot of structural members and/or brace members.

The first joint member 3 provides a first sleeve 30 providing a longitudinal hole 30*m* formed therein for inserting the steel rod 1, the end face of which contacts a back surface of the swelled portion 1A so as not to fall off from the steel rod, and a first connecting adapter 300 for joining the first sleeve 30 to one connector node 2M. The second joint member 4 provides a longitudinal threaded hole 40*m* formed therein for inserting another end of steel rod 1, which covers and engages the threaded connector portion 1B, and a second connecting adapter 400 for joining the second sleeve 40 to another connector node 2N.

The first sleeve 30 is similar to the first sleeve 3 described in FIG. 1, which comprises a first external threaded part 30A corresponding to the first joining threaded part 3A described above, and a first polygonal swelled part 30B, having torquing surfaces 30*b* formed on the outer surface thereof, corresponding to the first polygonal swelled part 3B describe, above. A first adapter-contact face 30*c* is formed at the boundary between the first polygonal swelled part 30B and the first external threaded part 30A, which contacts the first connecting adapter 300, and a swelled portion-contact face 30*a* is formed at the end of the first external threaded part 30A.

The first connecting adapter 300 comprises a first joining threaded part 300A, a first polygonal swelled part 300B and a first conical part 300C. The first joining threaded part 300A is formed on the outer surface of node side of the first connecting adapter, the major diameter of which is smaller than that of the first external threaded part 30A. The first polygonal swelled part 300B has torquing surfaces 300*b* and a longitudinal screw hole 300*m* formed therein for engaging first external threaded part 30A. The torquing surfaces 300*b* are formed on the outer surface of the first polygonal swelled part to rotate the first connecting adapter for engagement of the first joining threaded part 300A to a connecting screw hole 2*m* of connector node 2M. The first conical part 300C is formed between the first polygonal swelled part 300B and the first joining threaded part 300A, the diameter of the end of node side of which is smaller than that of the end of counter-node side thereof. A first node-contact face 300*c* is formed at the boundary between the first conical part 300C and the first joining threaded part 300A, which contacts the connector node 2M.

The second sleeve 40 comprises a second external threaded part 40A corresponding to the second joining threaded part 4A described in FIG. 1, and a second polygonal swelled part 40B corresponding to the second polygonal swelled part 4B described above. A second adapter-contact face 40*c* is formed at the boundary between the second polygonal swelled part 40B and the second external threaded part 40A. An adjusting screw hole 40*a* is formed inside the second external threaded part 40A, which communicates with the longitudinal threaded hole 40*m* and engages an adjusting screw bolt 5.

The second connecting adapter 400 comprises a second joining threaded part 400A, a second polygonal swelled part 400B and a second conical part 400C. The second joining threaded part 400A is formed on the outer surface of node side of the second connecting adapter, the major diameter of which is smaller than that of the second external threaded part 40A. The second polygonal swelled part 400B has torquing surfaces 400*b* and a longitudinal screw hole 400*m* formed therein for engaging second external threaded part 40A. The torquing surfaces 400*b* are formed on the outer surface of the second polygonal swelled part to rotate the second connecting adapter for engagement of the second joining threaded part 400A to a connecting screw hole 2*n* of connector node 2N. The second conical part 400C is formed between the second polygonal swelled part 400B and the second joining threaded part 400A, the diameter of the end of node side of which is smaller than that of the end of counter-node side thereof. A second node-contact face 400*c* is formed at the boundary between the second conical part 400C and the second joining threaded part 400A.

The longitudinal groove 400M, deeply drawn in Figure, having the longitudinal screw hole 400*m* for engaging second sleeve 40 at the opening side thereof should be deep enough to engage the second external threaded part 40A. On the other hand, referring to FIG. 10, depth $L_{300M}$ of the longitudinal groove 300M having the longitudinal screw hole 300*m* for engaging first sleeve 30 at the opening side thereof is defined to be equal to and/or more than the difference of the summation of length $L_{30A}$ of the first external threaded part 30A, length $L_{1A}$ of the swelled portion 1A and length $L_{400A}$ of the second joining threaded part 400A from length $L_{PT}$ for generating a preferable elongation enough to introduce regulated pretension into the steel rod 1.

In consideration of joining work of brace members most of threaded parts and screws are generally right-handed ones. On the other hand the direction of spiral of the threaded connector portion 1B is selected opposite that of the second joining threaded part 400A etc.

Consequently, the selection of such spiral directions prevents the engagement of the threaded connector portion 1B the longitudinal threaded hole 40*m* from releasing in response to engaging second joining threaded part 400A to the connecting screw hole 2*n*. Accordingly, the length $L_{0Aa}$ from the end face of swelled portion 1A to the end face of second joining threaded part 400A is maintained under no axial force acting on the steel rod 1.

In engaging the second joining threaded part 400A to the connecting screw hole 2*n*, the second connecting adapter 400 is rotated together with the second sleeve 40 by engagement of a wrench with both torquing surfaces 400*b* of second polygonal swelled part 400B of the second connecting adapter 400 and torquing surfaces 40*b* formed on the outer surface of second polygonal swelled part 40B of the second sleeve 40. The engagement of the second sleeve 40 with the second connecting adapter 400 is slightly released when the torquing surfaces 40*b* does not coincide with the torquing surfaces 400*b*.

The rotation of one swelled part within 30 degrees provides a coincidence of both torquing surfaces since both swelled part are polygonal. When the engagement of the second external threaded part 40A with the longitudinal screw hole 400*m* is released as above, the second sleeve 40 must be tightly reengage to the second connecting adapter 400 by rotating the second polygonal swelled part 40B after an entire engagement of the second joining threaded part 400A to the connecting screw hole 2*n*. The spiral of the second external threaded part 40A provides a right-handed similarly to the second joining threaded part 400A since the threaded connector portion 1B is left-handed.

Figure 7:
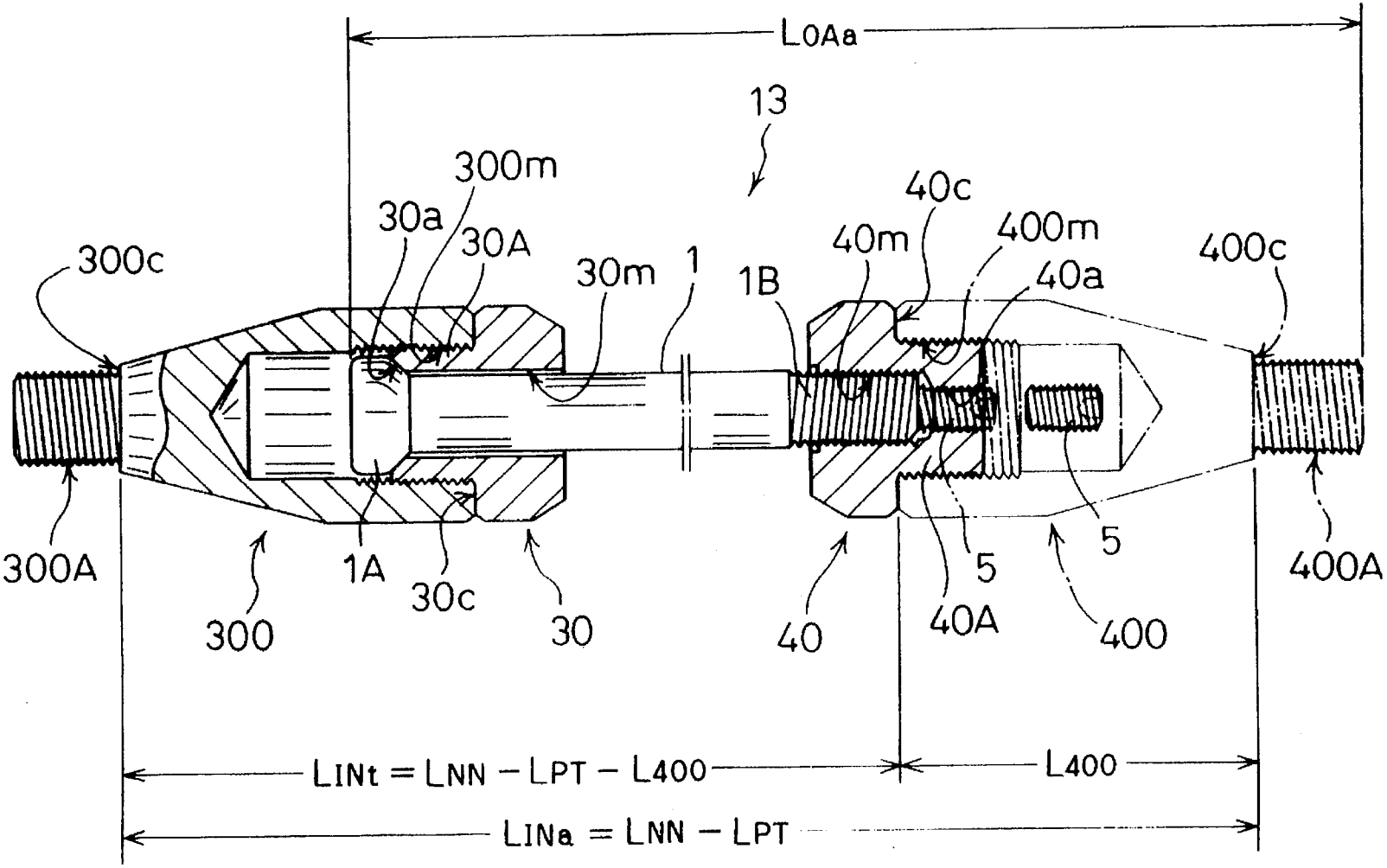
FIG. 7 is a sectional view of a brace member, disclosed in the second embodiment, having an overall length regulated by adjusting the length of engagement.

The procedure for joining a brace member, into which regulated pretension is introduced, to nodes is as follows:

Referring to FIG. 7, the threaded connector portion 1B of steel rod 1 is inserted into the longitudinal hole 30*m* of first sleeve 30 from the side of first external threaded part 30A until the swelled portion-contact face 30*a* contacts the surface of counter-node side of the swelled portion 1A. And the first external threaded part 30A is engaged to the longitudinal screw hole 300*m* until the first adapter-contact face 30*c* of first sleeve 30 contacts the end face of first connecting adapter 300.

Figure 10:
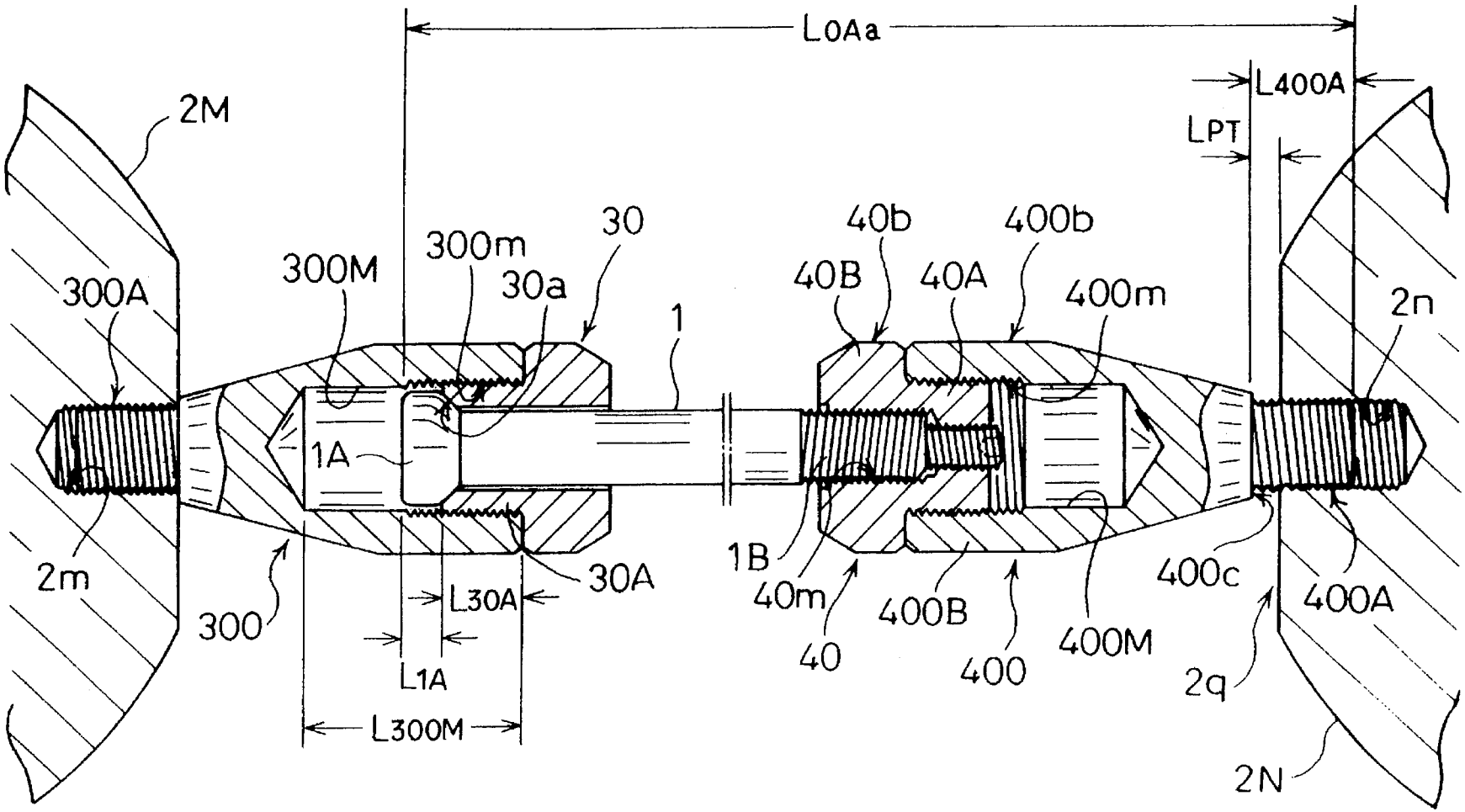
FIG. 10 is a sectional view of a brace member, disclosed in the second embodiment, just prior to the completion of joining to connector nodes.

The threaded connector portion 1B is covered with the second sleeve 40, and is engaged to the longitudinal threaded hole 40*m* by the left-hand rotation of the second sleeve so that the length from the first node-contact face 300*c* of first connecting adapter 300 to the second adapter-contact face 40*c* of second sleeve 40 is equal to the difference $L_{INa}$, of the designed length $L_{NN}$, see FIG. 6, between two unmovable connector nodes 2, 2 from the summation of length $L_{PT}$, see FIG. 10, for generating a preferable elongation enough to introduce regulated pretension into the steel rod and length $L_{400}$ of second connecting adapter 400 except the second joining threaded part 400A.

The adjusting screw bolt 5 is engaged to the adjusting screw hole 40*a* formed inside the second external threaded part 40A until the adjusting screw bolt 5 contacts the threaded connector portion 1B as shown by double dotted chain lines. And the second external threaded part 40A is engaged to the longitudinal screw hole 400*m* until the second adapter-contact face 40*c* of second sleeve 40 contacts the end face of second connecting adapter 400.

The procedure described above establishes an overall length $L_{0Aa}$ from the end face of the swelled portion 1A of steel rod 1 to the end face of the second joining threaded part 400A of second connecting adapter 400. Simultaneously, the difference $L_{INa}$ of length $L_{NN}$ between two nodes 2, 2 from length $L_{PT}$, see FIG. 10, for generating a preferable elongation enough to introduce regulated pretension into the steel rod is given between the first node-contact face 300*c* of first connecting adapter 300 and the second node-contact face 400*c* of second connecting adapter 400.

Figure 8:
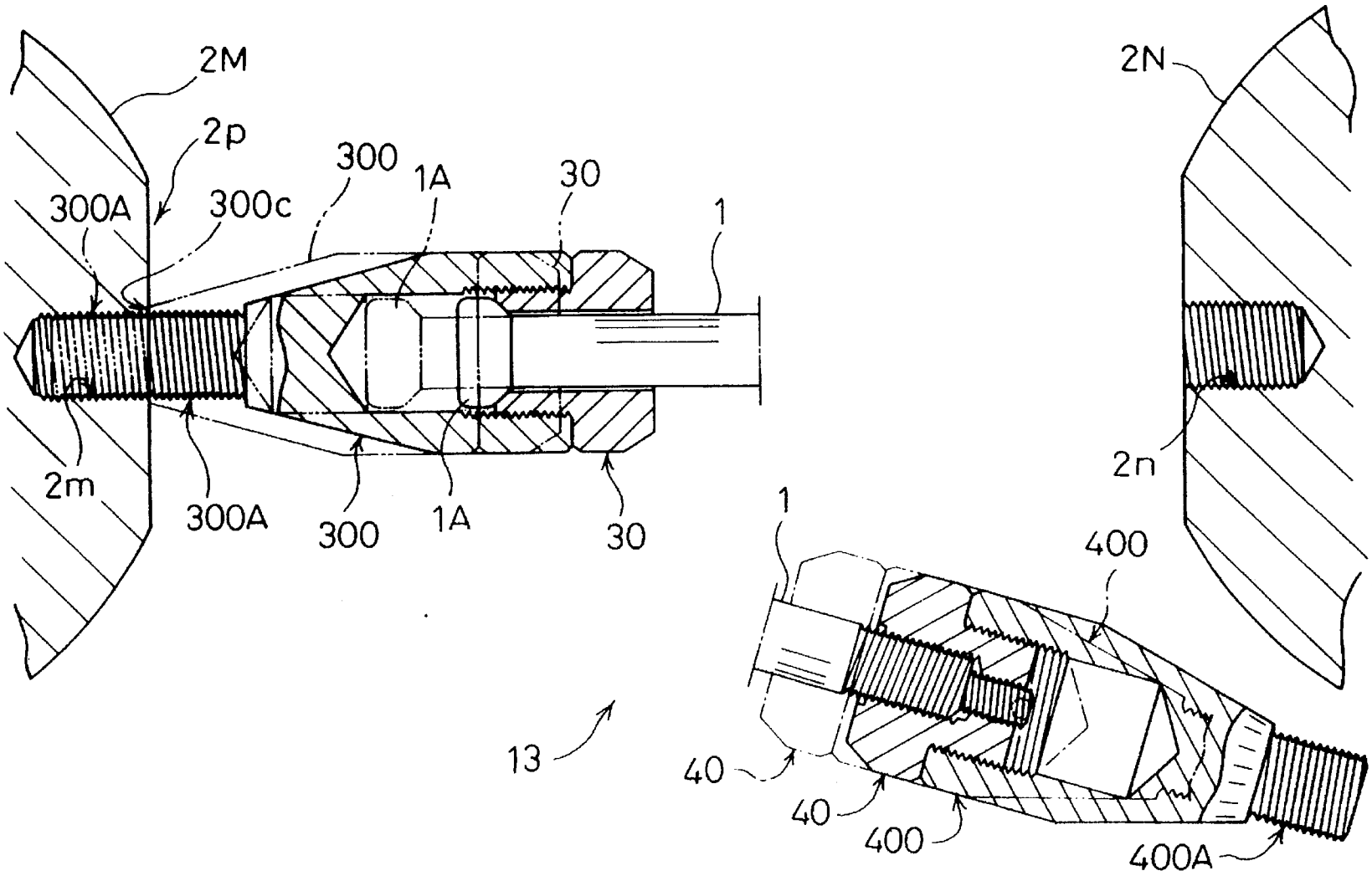
FIG. 8 is a sectional view of a brace member, disclosed in the second embodiment, initially operated for joining after hoisting a brace member to connector nodes.

A brace member 13 are hoisted to a grid in the truss structure and the first connecting adapter 300 is faced the connecting screw hole 2*m* of one connector node 2M as shown by solid lines in FIG. 8. Engaging the first joining threaded part 300A to the connecting screw hole 2*m* makes the first node-contact face 300*c* contact the flat face 2*p* of connector node 2M by rotation of both the first sleeve 30 and the first connecting adapter 300. The second connecting adapter 400 is in proximity of another connector node 2N since a long steel rod 1 is deflectable.

Figure 9:
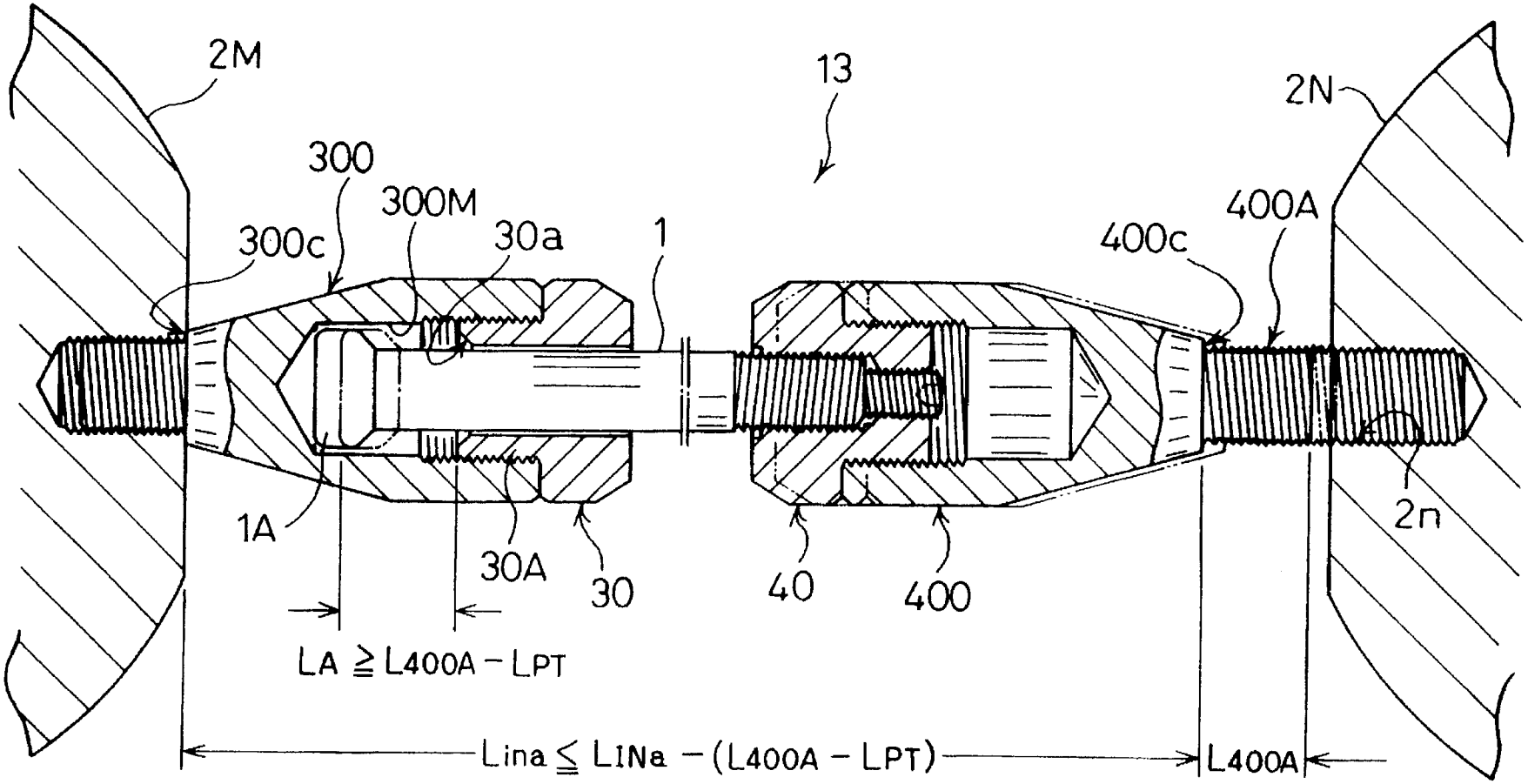
FIG. 9 is a sectional view of a brace member, disclosed in the second embodiment, disposed between connector nodes.

Referring to FIG. 9, the swelled portion 1A is inserted into the longitudinal groove 300M of first connecting adapter 300 by pushing the steel rod 1 in the direction of the connector node 2M. The length LA between the swelled portion 1A inside the longitudinal groove 300M and the swelled portion-contact face 30*a* of first external threaded part 30A becomes equal to and/or more than the difference of length $L_{400A}$ of the second joining threaded part 400A from length $L_{PT}$ for generating a preferable elongation enough to introduce regulated pretension into the steel rod. Accordingly, the second sleeve 40 and the second connecting adapter 400 move in the direction of the first sleeve 30 in response to the movement of steel rod 1.

Consequently, the length $L_{ina}$ from the first node-contact face 300*c* of first connecting adapter 300 to the second node-contact face 400*c* of second connecting adapter 400 comes to be less than $L_{INa}-(L_{400A}-L_{PT})$. Since $L_{INa}$ is the difference of length $L_{PT}$ between unmovable nodes 2M, 2N from length $L_{PT}$ for generating a preferable elongation enough to introduce regulated pretension into the steel rod, see FIG. 7, a following equation is given.

$$\begin{aligned} L_{ina} &\leqq L_{INa}-(L_{400_A}-L_{PT}) \\ &= (L_{NN}-L_{PT})-(L_{400_A}-L_{PT}) \\ &= L_{NN}-L_{400_A} \end{aligned}$$

The length $L_{ian}+L_{400A}$ from the first node-contact face 300*c* of first connecting adapter 300 to the end face of second joining threaded part 400A of the second connecting adapter 400 is given as follows:

$$L_{ina}+L_{400A} \leqq L_{NN}$$

This means that the second connecting adapter 400 is to face the connecting screw hole 2*n* of connector node 2N as shown in FIG. 9.

A little pulling the steel rod 1 in the right-hand direction as shown by double dotted chain lines makes the second joining threaded part 400A contact the opening of connecting screw hole 2*n* of connector node 2N. The light right-hand rotation of second sleeve 40 and the second connecting adapter 400 achieves an engagement of the second joining threaded part 400A to the connecting screw hole 2*n*. The rotation of second sleeve 40 and second connecting adapter 400 becomes heavily as soon as the end face of counter-node side of swelled portion 1A contacts the swelled portion-contact face 30*a* of first external threaded part 30A as shown in FIG. 10.

According to the procedure described above, the length from the end face of swelled portion 1A to the end face of second joining threaded part 400A is reappeared to $L_{OAa}$ presented in FIG. 7. In addition, the length $L_{PT}$ for generating an elongation remains between the second node-contact face 400*c* of second connecting adapter 400 and the flat face 2*q* of connector node 2N. Torquing second sleeve 40 and second connecting adapter 400 by a wrench engaging second polygonal swelled parts 40B and 400B thereof elastically elongates the steel rod 1 since the nodes 2M, 2N are not moved by the grids already constructed close thereto.

As shown in FIG. 6, the entire engagement of the second joining threaded part 400A to the connecting screw hole 2*n* until the second node-contact face 400*c* contacts the flat face 2*q* gives the steel rod 1 a preferable elongation introducing regulated pretension thereinto.

In accordance with the above structure, the brace member, length of which is regulated as shown in FIG. 7, is joinable to both nodes by moving the swelled portion 1A inside the longitudinal groove 300M of first connecting adapter 300 even if the length between nodes have already established. The reversal procedure naturally enables to remove a brace member from a grid.

Figure 11:
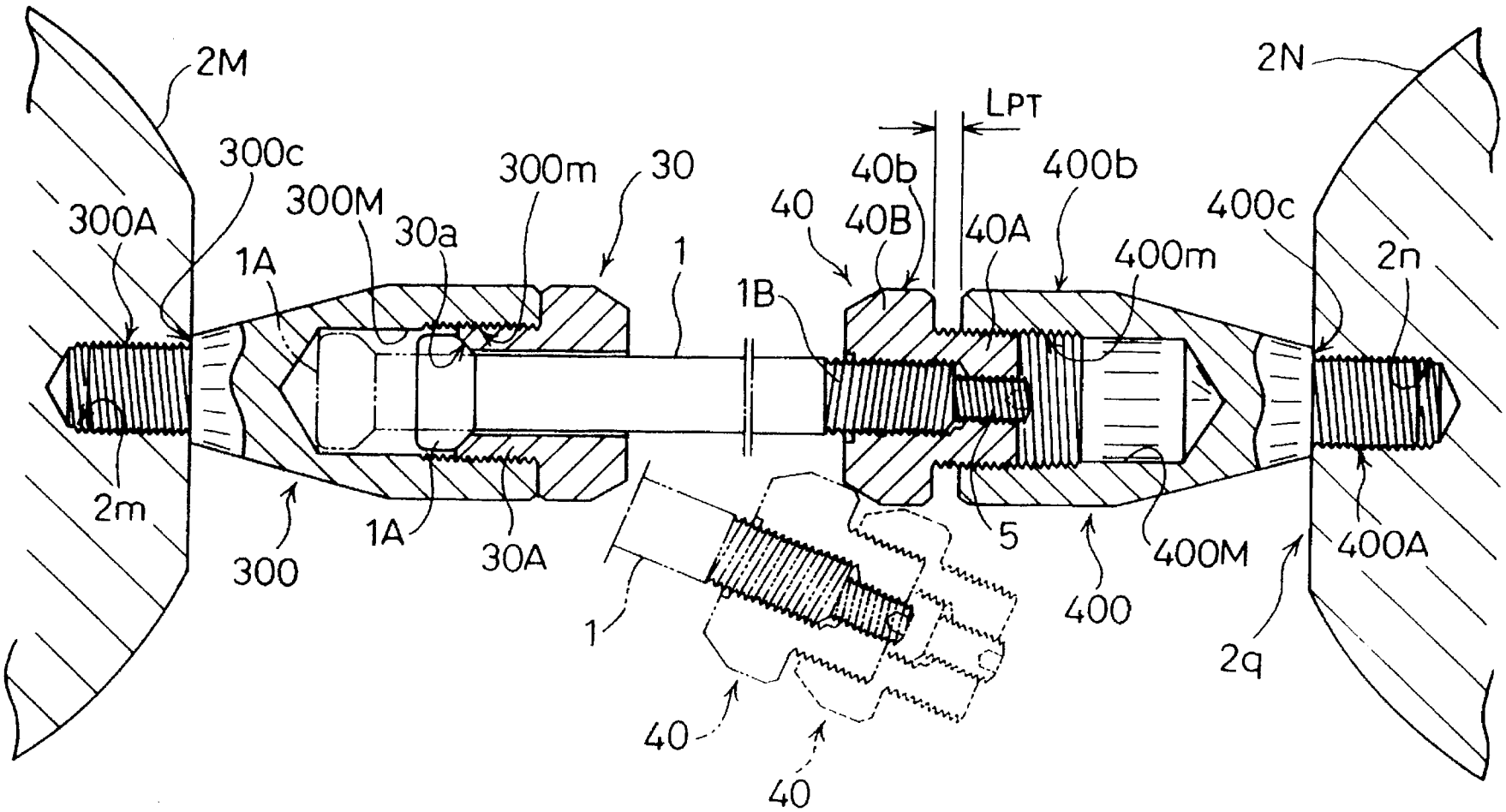
FIG. 11 is a sectional view of a brace member, disclosed in the second embodiment, joined to connector nodes by means of a different procedure.

A following procedure is also available to the joint device described above. Referring to FIG. 11, the first connecting adapter 300 is engaged with the connecting screw hole 2*m* of one connector node 2M until the first node-contact face 300*c* contacts the connector node 2M. And the second connecting adapter 400 is engaged with the connecting screw hole 2*n* of another connector node 2N until the second node-contact face 400*c* contacts the connector node 2N.

In this case, the longitudinal screw hole 300*m* formed in a longitudinal groove 300M of the first connecting adapter 300 is regarded as a connecting screw hole of one connector node described in the previous embodiment, and the longitudinal screw hole 400*m* formed in a second connecting adapter 400 is regarded as a connecting screw hole of another connector node of the previous embodiment. Accordingly, on regarding a brace member as an assembly comprising a first sleeve 30, a steel rod 1, a second sleeve 40 and an adjusting screw bolt 5, it is joinable to two unmovable connecting adapters and regulated pretension is introduced thereinto similarly to the processes from FIG. 2 to FIG. 5 and FIG. 5 to FIG. 1.

The depth of the longitudinal groove 300M of first connecting adapter 300 is selected equal to and/or more than the difference of the summation of the length of first external threaded part 30A, the length of swelled portion 1A and the length of second external threaded part 40A from the length $L_{PT}$ for generating a preferable elongation enough to introduce regulated pretension into the steel rod 1. The direction of spiral of the threaded connector portion 1B is selected opposite that of the second external threaded part 40A.

Figure 12:
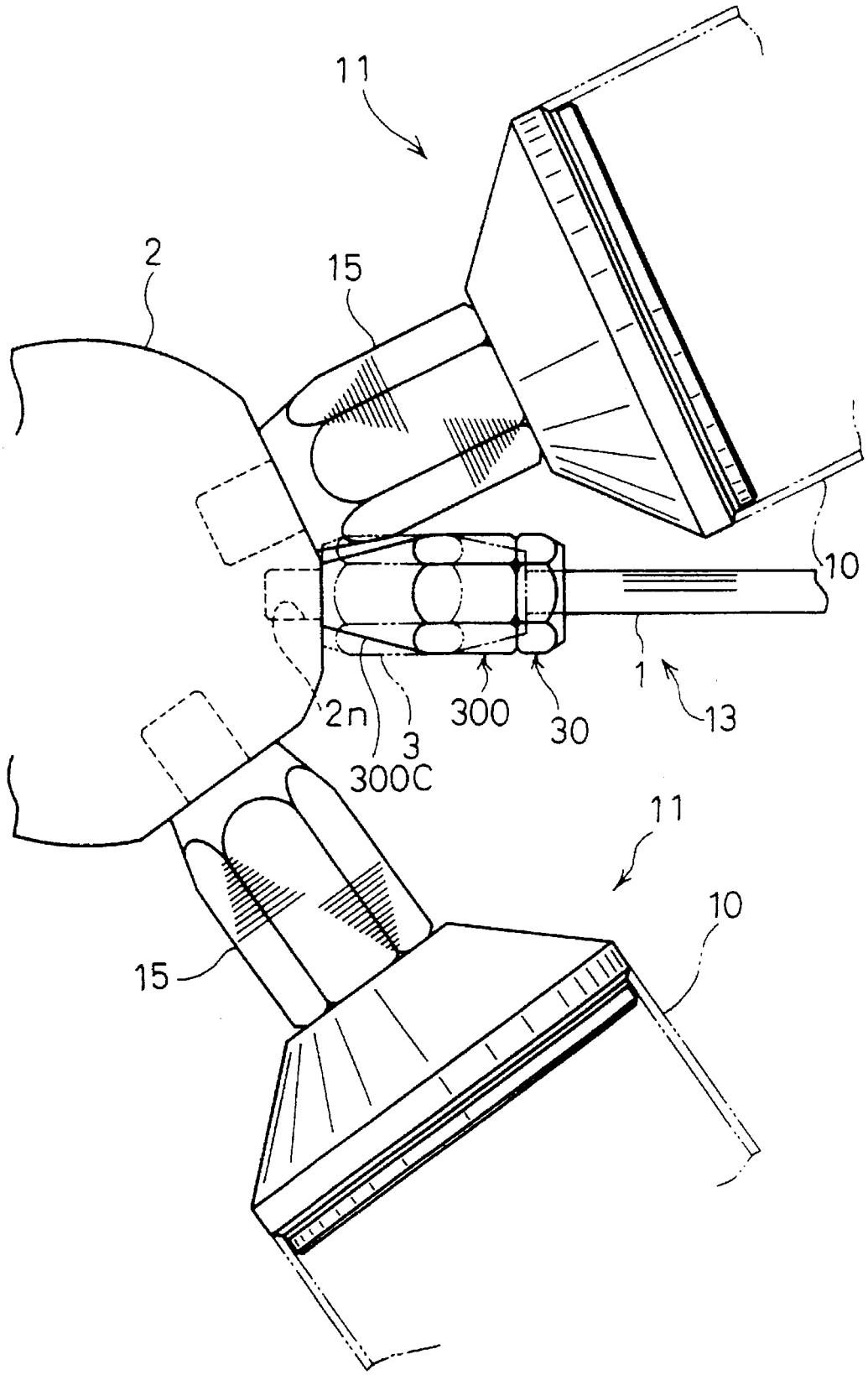
FIG. 12 is a schematic view of a brace member and structural members joined to a node.

FIG. 12 shows an example of a node joining a brace member 13 close to some structural members 11 made of steel pipes 10. Use of a first connecting adapter 300 engaging a first sleeve 30 shown by solid lines enables to join a brace member to the node without interference with a joint device 15 for joining a structural member 11, being different from the sleeve 3 described in FIG. 1, which is drawn by double dotted chain lines.

Needless to say, non-interference described above is achieved by a first connecting adapter 300 having a first conical part 300C, similarly to an undrawn second connecting adapter 400.

Figure 13:
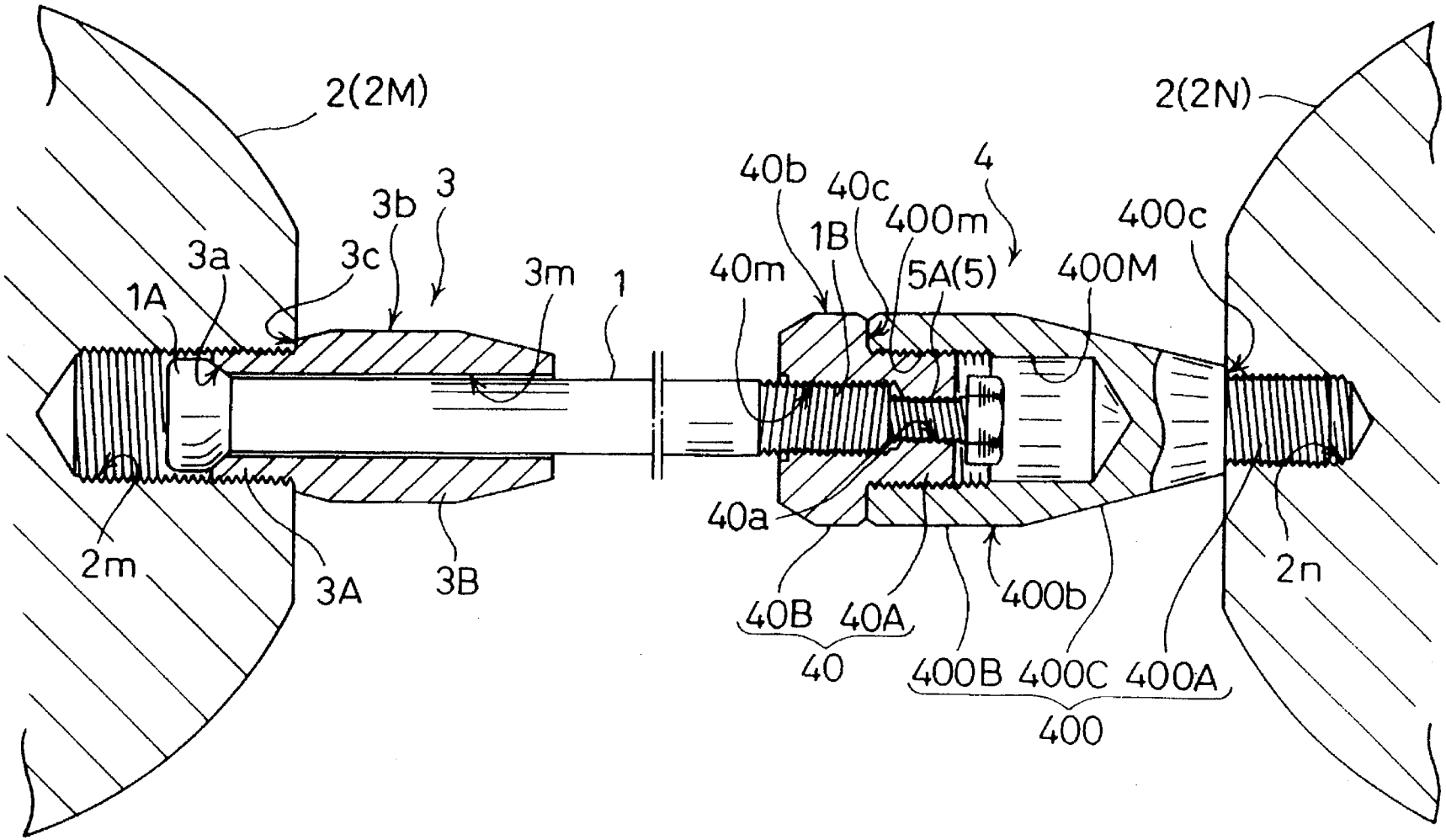
FIG. 13 is a sectional view of a third embodiment providing a brace member joined to nodes by a device according to the present invention.

FIG. 13 shows a joint device providing a first sleeve 3 as a first joint member, and a second sleeve 40 and a second connecting adapter 400 as a second joint member, corresponding to claim 3 of the present invention. The detailed explanation of this example is omitted by describing symbols used in previous examples into the Figure.

The first sleeve 3 is engaged to the connecting screw hole 2*m* of one connector node 2M until the first node-contact face 3*c* contacts the connector node 2M. And the second connecting adapter 400 is engaged to the connecting screw hole 2*n* of another connector node 2N until the second node-contact face 400*c* contacts the connector node 2N. A brace member comprising a first sleeve 3, a steel rod 1 and a second sleeve 40 is joined to nodes, similarly to the first embodiment, by regarding the longitudinal screw hole 400*m* formed in a longitudinal groove 400M of second connecting adapter 400 as a connecting screw hole of another connector node.

Figure 14:
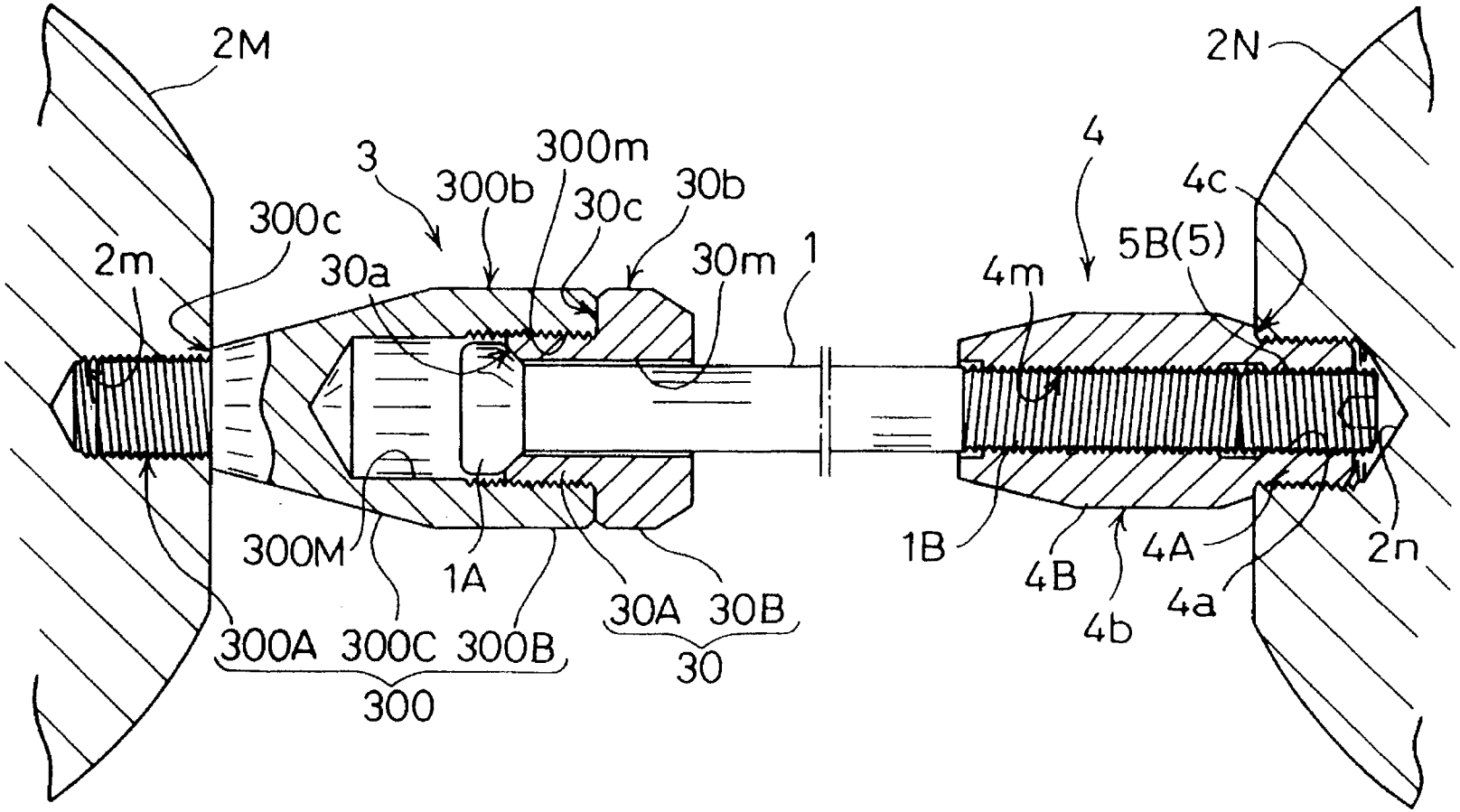
FIG. 14 is a sectional view of a fourth embodiment providing a brace member joined to nodes by a device according to the present invention.

FIG. 14 shows a joint device providing a first sleeve 30 and a first connecting adapter 300 as a first joint member 3, and a second sleeve 4 as a second joint member, corresponding to claim 4 of the present invention.

The connecting adapter 300 is engaged to the connecting screw hole 2*m* of one connector node 2M until the first node-contact face 300*c* contacts the connector node 2M. And the second sleeve 4 is engaged to the connecting screw hole 2*n* of another connector node 2N until the second node-contact face 4*c* contacts the connector node 2N. A brace member, into which regulated pretension is introduced, comprising a first sleeve 30, a steel rod 1 and a second sleeve 4 is joined to two unmovable nodes, similarly to the first embodiment, by regarding the longitudinal screw hole 300*m* formed in the longitudinal groove 300M of connecting adapter 300 as a connecting screw hole of one connector node.

As shown in FIG. 13, a conventional bolt 5A is available to an adjusting screw bolt. Referring to FIG. 14, an adjusting screw bolt 5B, having a diameter equal to and/or more than that of a threaded connector portion 1B, is also available to an adjusting screw bolt.

Figure 15:
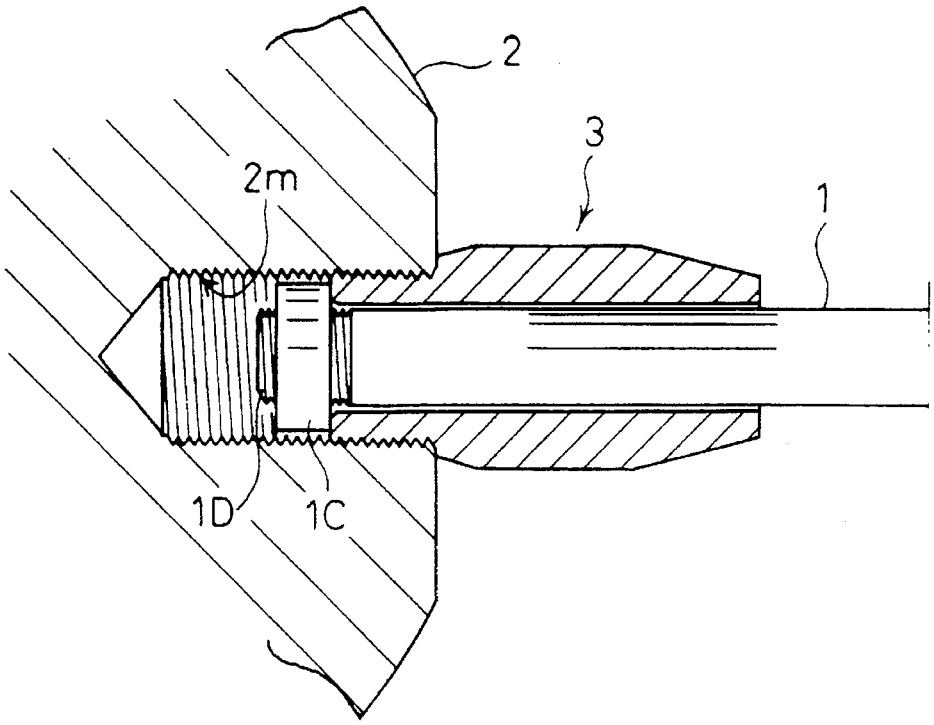
FIG. 15 is a partially sectional view of a brace member, disclosed in the first embodiment, using a nut instead of a swelled portion.
Figure 16:
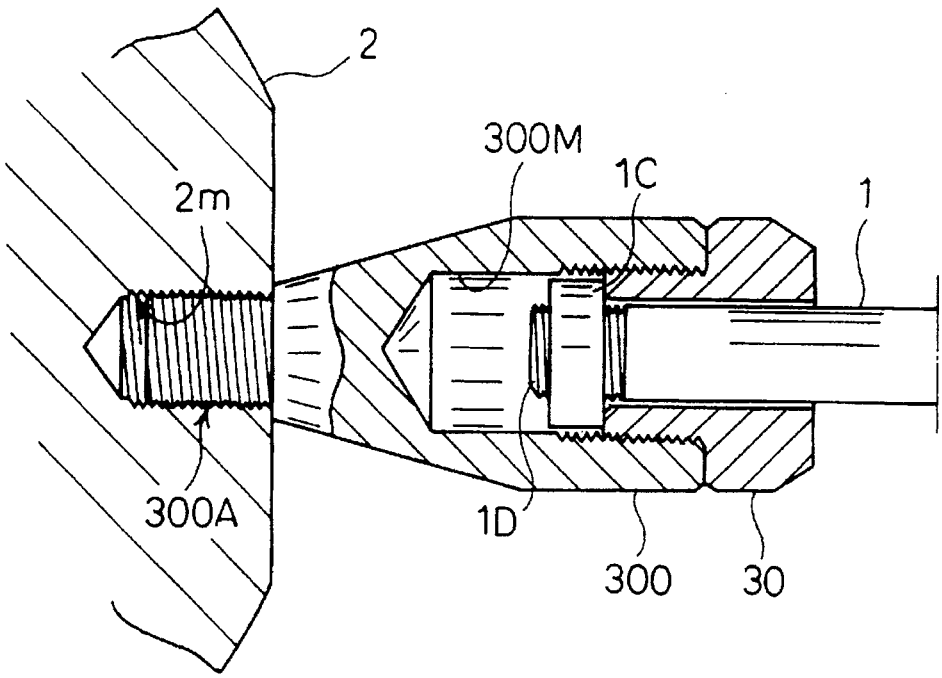
FIG. 16 is a partially sectional view of a brace member, disclosed in the second embodiment, using a nut instead of a swelled portion.

FIG. 15 and FIG. 16 are devices, partially drawn, comprising a circular nut 1C installed at the end of a steel rod 1 instead of a swelled portion 1B described above. The nut 1C is engaged with an external threaded portion 1D formed on the end of a steel rod 1 and is fixed each other by using an adhesive material for screw locking.

We claim:

1. A joint device for joining a pretensioned brace member to connector nodes on the diagonal line of a grid formed in a space truss structure assembled by using structural members, comprising:

a brace member having a steel rod providing a swelled portion formed at one end thereof and a threaded connector portion formed on the outer surface of another end thereof, a first joint member for connecting said one end of the steel rod to one connector node, and a second joint member for connecting said another end of the steel rod to another connector node, said first joint member being a first sleeve providing a longitudinal hole formed therein for inserting said steel rod, an end face of which contacts a back surface of said swelled portion so as not to fall off from said steel rod, said second joint member being a second sleeve providing a longitudinal threaded hole formed therein for inserting said another end of the steel rod, which covers and engages said threaded connector portion, said first sleeve comprising a first joining threaded part formed on the outer surface of node side thereof, the minor diameter of which is larger than the diameter of said swelled portion, a first polygonal swelled part having torquing surfaces formed on the outer surface thereof to rotate said first sleeve for engagement of said first joining threaded part to a connecting screw hole of the connector node, a first node-contact face formed at the boundary between said first polygonal swelled part and said first joining threaded part, which is able to contact a flat face of the node, and a swelled portion-contact face formed at the end of the node side of the first joining threaded part, which contacts a back surface of a counter-node side of said swelled portion, said second sleeve comprising a second joining threaded part formed on the outer surface of a node side thereof, a second polygonal swelled part having torquing surfaces formed on the outer surface thereof to rotate the second sleeve for engagement of said second joining threaded part to a connecting screw hole of another connector node, a second node-contact face formed at the boundary between said second polygonal swelled part and said second joining threaded part, which is able to contact a flat face of the node, an adjusting screw hole formed inside said second joining threaded part, which communicates with said longitudinal threaded hole, and an adjusting screw bolt engaging said adjusting screw hole, which regulates the length of engagement of said threaded connector portion with said longitudinal threaded hole in response of the contact with said another end face of the steel rod, the depth of said connecting screw hole of the connector node being defined to be equal to or more than the difference of the summation of the length of said first joining threaded part, the length of said swelled portion and the length of said second joining threaded part from the length for generating a preferable elongation enough to introduce regulated pretension into said steel rod, and the spiral direction of said threaded connector portion being selected opposite that of said second joining threaded part.

2. A joint device for joining a pretensioned brace member to connector nodes on the diagonal line of a grid formed in a space truss structure assembled by using structural members, comprising:

a brace member having a steel rod providing a swelled portion formed at one end thereof and a threaded connector portion formed on the outer surface of another end thereof, a first joint member for connecting said one end of the steel rod to one connector node, and a second joint member for connecting said another end of the steel rod to another connector node, said first joint member being a first sleeve providing a longitudinal hole formed therein for inserting said steel rod, an end face of which contacts a back surface of said swelled portion so as not to fall off from said steel rod, and a first connecting adapter for joining said first sleeve to one connector node, said second joint member being a second sleeve providing a longitudinal threaded hole formed therein for inserting said another end of the steel rod, which covers and engages said threaded connector portion, and a second connecting adapter for joining said second sleeve to another connector node, said first sleeve comprising a first external threaded part formed on the outer surface of a node side thereof, the minor diameter of which is larger than the diameter of said swelled portion, a first polygonal swelled part having torquing surfaces formed on the outer surface thereof to rotate said first sleeve for engagement of said first external threaded part to a longitudinal screw hole inside said first connecting adapter, a first adapter-contact face formed at the boundary between said first polygonal swelled part and said first external threaded part, which contacts said first connecting adapter, and a swelled portion-contact face formed at the end of the node side of the first external threaded part, which contacts a back surface of a counter-node side of said swelled portion, said first connecting adapter comprising a first joining threaded part formed on the outer surface of a node side thereof, the major diameter of which is smaller than that of said first external threaded part, a first polygonal swelled part having torquing surfaces formed on the outer surface thereof to rotate said first connecting adapter for engagement of said first joining threaded part to said connecting screw hole of the connector node and a longitudinal screw hole for engaging said first external threaded part, and a first conical part formed between said first polygonal swelled part and said first joining threaded part, the diameter of the end of the node side of which is smaller than that of the end of a counter-node side thereof, having a first node-contact face formed at the boundary between itself and said first joining threaded part, which is able to contact the connector node, said second sleeve comprising a second external threaded part formed on the outer surface of a node side thereof, a second polygonal swelled part having torquing surfaces formed on the outer surface thereof to rotate said second sleeve for engagement of said second external threaded part to a longitudinal screw hole formed inside said second connecting adapter, a second adapter-contact face formed at the boundary between said second polygonal swelled part and said second external threaded part, which contacts said second connecting adapter, an adjusting screw hole formed inside said second external threaded part, which communicates with said longitudinal threaded hole, and an adjusting screw bolt engaging said adjusting screw hole, which regulates the length of engagement of said threaded connector portion with said longitudinal threaded hole in response of the contact with said another end face of the steel rod, said second connecting adapter comprising a second joining threaded part formed on the outer surface of a node side thereof, the major diameter of which is smaller than that of said second external threaded part, a second polygonal swelled part having torquing surfaces formed on the outer surface thereof to rotate said second connecting adapter for engagement of said second joining threaded part to said connecting screw hole of the connector node and a longitudinal screw hole for engaging said second external threaded part, and a second conical part formed between said second polygonal swelled part and said second joining threaded part, the diameter of the end of the node side of which is smaller than that of the end of a counter-node side thereof, having a second node-contact face formed at the boundary between itself and said second joining threaded part, which is able to contact the connector node, the depth of the longitudinal groove having a longitudinal screw hole of said first connecting adapter being defined to be equal to or more than the difference of the summation of the length of said first external threaded part, the length of said swelled portion and the length of said second joining threaded part from the length for generating a preferable elongation enough to introduce regulated pretension into the steel rod, and the spiral direction of said threaded connector portion being selected opposite that of said second joining threaded part.

3. A joint device for joining a pretensioned brace member to connector nodes on the diagonal line of a grid formed in a space truss structure assembled by using structural members, comprising:

a brace member having a steel rod providing a swelled portion formed at one end thereof and a threaded connector portion formed on the outer surface of another end thereof, a first joint member for connecting Said one end of the steel rod to one connector node, and a second joint member for connecting said another end of the steel rod to another connector node, said first joint member being a first sleeve providing a longitudinal hole formed therein for inserting said steel rod, an end face of which contacts a back surface of said swelled portion so as not to fall off from said steel rod, said second joint member being a second sleeve providing a longitudinal threaded hole formed therein for inserting said another end of the steel rod, which covers and engages said threaded connector portion, and a connecting adapter for joining said second sleeve to another connector node, said first sleeve comprising a first joining threaded part formed on the outer surface of a node side thereof, the minor diameter of which is larger than the diameter of said swelled portion, a first polygonal swelled part having torquing surfaces formed on the outer surface thereof to rotate said first sleeve for engagement of said first joining threaded part to a connecting screw hole of the connector node, a first node-contact face formed at the boundary between said first polygonal swelled part and said first joining threaded part, which is able to contact a flat face of the node, and a swelled portion-contact face formed at the end of the node side of the first joining threaded part, which contacts a back surface of a counter-. node side of said swelled portion, said second sleeve comprising an external threaded part formed on the outer surface of a node side thereof, a second polygonal swelled part having torquing surfaces formed on the outer surface thereof to rotate said second sleeve for engagement of said external threaded part to a longitudinal screw hole formed inside said connecting adapter, an adapter-contact face formed at the boundary between said second polygonal swelled pan and said external threaded part, which contacts said connecting adapter, an adjusting screw hole formed inside said external threaded part, which communicates with said longitudinal threaded hole, and an adjusting screw bolt engaging said adjusting screw hole, which regulates the, length of engagement of said threaded connector portion with said longitudinal threaded hole in response of the contact with said another end face of the steel rod, said connecting adapter comprising a second joining threaded part formed on the outer surface of a node side thereof, the major diameter of which is smaller than that of said external threaded part, a polygonal swelled part having torquing surfaces formed on the outer surface thereof to rotate said connecting adapter for engagement of said second joining threaded part to said connecting screw hole of the connector node and a longitudinal screw hole for engaging said external threaded part, and a conical part formed between said polygonal swelled part and said second joining threaded part, the diameter of the end of the node side of which is smaller than that of the end of a counter-node side thereof, having a second node-contact face formed at the boundary between itself and said second joining threaded part, which is able to contact the connector node, the depth of said connecting screw hole of the connector node being defined to be equal to or more than the difference of the summation of the length of said first joining threaded part, the length of said swelled portion and the length of said second joining threaded part from the length for generating a preferable elongation enough to introduce regulated pretension into said steel rod, and the spiral direction of said threaded connector portion being selected opposite that of said second joining threaded part.

4. A joint device for joining a pretensioned brace member to connector nodes on the diagonal line of a grid formed in a space truss structure assembled by using structural members,, comprising:

a brace member having a steel rod providing a swelled portion formed at one end thereof and a threaded connector portion formed on the outer surface of another end thereof, a first joint member for connecting said one end of the steel rod to one connector node, and a second joint member for connecting said another end of the steel rod to another connector node, said first joint member being a first sleeve providing a longitudinal hole formed therein for inserting said steel rod, an end face of which contacts a back surface of said swelled portion so as not to fall off from said steel rod, and a connecting adapter for joining said first sleeve to one connector node, said second joint member being a second sleeve providing a longitudinal threaded hole formed therein for inserting said another end of the steel rod, which covers and engages said threaded connector portion, said first sleeve comprising an external threaded part formed on the outer surface of a node side thereof, the minor diameter of which is larger than the diameter of said swelled portion, a first polygonal swelled part having torquing surfaces formed on the outer surface thereof to rotate said first sleeve for engagement of said external threaded part to a longitudinal screw hole inside said connecting adapter, an adapter-contact face formed at the boundary between said first polygonal swelled part and said external threaded part, which contacts said connecting adapter, and a swelled portion-contact face formed at the end of the node side of the first external threaded part, which contacts a back surface of a counter-node side of said swelled portion, said connecting adapter comprising a first joining threaded part formed on the outer surface to: a node side thereof, the major diameter of which is smaller than that of said external threaded part, a polygonal swelled part having torquing surfaces formed on the outer surface thereof to rotate said connecting adapter for engagement of said first joining threaded part to said connecting screw hole of the connector node and a longitudinal screw hole for engaging said external threaded part, and a conical part formed between said polygonal swelled part and said first joining threaded part, the diameter of the end of the node side of which is smaller than that of the end of a counter-node side thereof, having a first node-contact face formed at the boundary between itself and said first joining threaded part, which is able to contact the connector node, said second sleeve comprising a second joining threaded part formed on the outer surface of a node side thereof, a second polygonal swelled part having torquing surfaces formed on the outer surface thereof to rotate the second sleeve for engagement of said second joining threaded part to a connecting screw hole of another connector node, a second node-contact face formed at the boundary between said second polygonal swelled part and said second joining threaded part, which is able to contact a flat face of the node, an adjusting screw hole formed inside said second joining threaded part, which communicates with said longitudinal threaded hole, and an adjusting screw bolt engaging said adjusting screw hole, which regulates the length of engagement of said threaded connector portion with said longitudinal threaded hole in response of the contact with Said another end face of the steel rod, the depth of the longitudinal groove having a longitudinal screw hole of said connecting adapter being defined to be equal to or more than the difference of the summation of the length of said external threaded part, the length of said swelled portion and the length of said second joining threaded part from the length for generating a preferable elongation enough to introduce regulated pretension into the steel rod, and the spiral direction of said threaded connector portion being selected opposite that of said second joining threaded part.

* * * * *